US011002158B2

(12) United States Patent
Smith

(10) Patent No.: US 11,002,158 B2
(45) Date of Patent: May 11, 2021

(54) CAMSHAFT PHASER USING BOTH CAM TORQUE AND ENGINE OIL PRESSURE

(71) Applicant: BorgWarner Inc., Auburn Hills, MI (US)

(72) Inventor: Franklin R. Smith, York, SC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 16/157,459

(22) Filed: Oct. 11, 2018

(65) Prior Publication Data

US 2019/0107014 A1 Apr. 11, 2019

Related U.S. Application Data

(60) Provisional application No. 62/571,036, filed on Oct. 11, 2017.

(51) Int. Cl.
*F01L 1/344* (2006.01)

(52) U.S. Cl.
CPC ..... *F01L 1/3442* (2013.01); *F01L 1/34409* (2013.01); *F01L 2001/3443* (2013.01); *F01L 2001/34426* (2013.01); *F01L 2001/34433* (2013.01); *F01L 2001/34453* (2013.01); *F01L 2250/02* (2013.01); *F01L 2250/04* (2013.01); *F01L 2250/06* (2013.01)

(58) Field of Classification Search
CPC ..... F01L 1/3442; F01L 1/34409; F01L 2001/3443; F01L 2250/02; F01L 2250/06; F01L 2001/34433; F01L 2250/04; F01L 2001/34426; F01L 2001/34453
USPC ..... 123/90.17, 90.15
See application file for complete search history.

(56) References Cited

U.S. PATENT DOCUMENTS

| | | | | |
|---|---|---|---|---|
| 6,453,859 | B1 | 9/2002 | Smith et al. | |
| 6,763,791 | B2 | 7/2004 | Gardner et al. | |
| 7,434,554 | B2 | 10/2008 | Nagashima | |
| 7,946,266 | B2 | 5/2011 | Knecht et al. | |
| 8,789,504 | B2 | 7/2014 | Scheidig | |
| 8,881,699 | B2 | 11/2014 | Church | |
| 8,931,451 | B2 | 1/2015 | Scheidig | |
| 2002/0139332 | A1 | 10/2002 | Takenaka | |
| 2011/0017156 | A1 | 1/2011 | Smith | |
| 2012/0097122 | A1* | 4/2012 | Lichti | F01L 1/3442 123/90.15 |
| 2015/0019106 | A1 | 1/2015 | Cunningham et al. | |
| 2015/0300213 | A1* | 10/2015 | Kaufmann | F16K 11/10 137/625.42 |
| 2016/0130988 | A1 | 5/2016 | Smith et al. | |
| 2017/0058727 | A1 | 3/2017 | Smith et al. | |
| 2017/0130618 | A1 | 5/2017 | Haltiner, Jr. | |

FOREIGN PATENT DOCUMENTS

| | | | | |
|---|---|---|---|---|
| DE | 102016104561 | A1 * | 9/2017 | F15B 13/04 |
| JP | 2000034913 | A | 2/2000 | |
| JP | 2009068500 | A | 4/2009 | |
| JP | 2009264133 | A | 11/2009 | |
| JP | 2011513651 | A | 4/2011 | |
| WO | WO-2017157900 | A1 * | 9/2017 | F01L 1/344 |

* cited by examiner

*Primary Examiner* — Patrick Hamo
*Assistant Examiner* — Wesley G Harris
(74) *Attorney, Agent, or Firm* — Brown & Michaels, PC

(57) ABSTRACT

A variable cam timing phaser with a control valve that can selectively user either CTA mode, TA mode or both CTA and TA mode simultaneously to actuate the phaser.

23 Claims, 18 Drawing Sheets

CAMSHAFT PHASER USING BOTH CAM TORQUE AND ENGINE OIL PRESSURE

CROSS-REFERENCE TO RELATED APPLICATIONS

This application claims the benefit of U.S. Patent Application No. 62/571,036 filed on Oct. 11, 2017, the disclosure of which is herein incorporated by reference in its entirety.

BACKGROUND OF THE INVENTION

Field of the Invention

The invention pertains to the field of variable cam timing. More particularly, the invention pertains to variable cam timing phasers using both cam torque and engine oil pressure.

Description of Related Art

In recent years Torsional Assist (TA) style phasers have dominated the variable camshaft timing (VCT) market. The limitations of TA phaser performance in relationship to the engine oil supply are well known. The TA phaser performance is tied directly to the source oil available. Low engine revolutions per minute (RPM) typically produces low oil pressure, therefore the actuation rate of the TA phaser has to be limited so as not to outperform the oil supply that is available. One solution to the shortcomings of a TA style phaser is to use camshaft torque actuation (CTA). This technology uses the camshaft torque energy, which is generated when the camshaft opens and closes the engine poppet valves, to make the variable camshaft timing (VCT) phaser move via camshaft torque actuation. The CTA phaser technology recirculates oil internal to the phaser. This consumes less oil, and therefore is much less dependent on the oil supply for actuation than a TA phaser. One limitation of the CTA phaser is that certain engines, such as in-line four (I-4) cylinder engines, have diminished camshaft torque energy at high engine RPM. For this reason a CTA phaser is not optimally suited for all I-4 engines under all operating conditions.

A blending or combining of the CTA and TA technologies into one VCT phaser offers a solution to address both the TA and CTA VCT limitations while creating a VCT phaser design that minimizes the use of oil while actuating. At low RPMs, CTA technology can be used to actuate the VCT because camshaft torque energy is readily available to energize the phaser and at high RPMs, TA technology can be used because sufficient engine oil pressure is available to energize the phaser.

A conventional "switchable" VCT phaser control valve, as shown in FIG. 1, employs both a CTA mode of recirculating oil inside the phaser while actuating and a TA mode that uses engine oil pressure to actuate the phaser. Referring to FIG. 1, the control valve 9 has a sleeve 16 received within a bore 8*a* of center bolt 8. The sleeve 16 has a first sleeve port 17, a second sleeve port 18, a third sleeve port 19, a fourth sleeve port 20, a fifth sleeve port 21, and a sixth sleeve port 22. The fifth sleeve port 21 and the sixth sleeve port 22 are connected through a groove 7. The center bolt 8 has a first center bolt port 23, a second center bolt port 24, a third center bolt port 25, a vent 26, and a fourth center bolt port 27. The first sleeve port 17 is in alignment with the first center bolt port 23. The second sleeve port 18 is in alignment with the second center bolt port 24. The third sleeve port 19 is in alignment with the third center bolt port 25. The fourth sleeve port 20 is in alignment with the fourth center bolt port 27.

Slidably received within the sleeve 16 is a spring 15 biased spool 28. The spool 28 has a series of lands 28*a*, 28*b*, 28*c*, 28*d*, 28*e*. Within the body of the spool 28 is a first central passage 29, a second central passage 30, a CTA recirculation check valve 2, and an inlet check valve 1. A first spool port 31 is present between spool lands 28*a* and 28*b* and in fluid communication with the first central passage 29. A second spool port 32 and a third spool port 33 are present between spool lands 28*b* and 28*c* and are separated by an additional land 28*f* The second spool port 32 receives an output of the CTA recirculation check valve 2. The third spool port 33 receives an output of the inlet check valve 1. The fourth spool port 34 is present between spool land 28*d* and 28*e* and is in fluid communication with the second central passage 30. The fourth spool port 34 receives fluid from the third center bolt port 25.

A first recirculation path 3*a* flows from the second center bolt port 24 and second sleeve port 18, between spool lands 28*c* and 28*d* to the fifth sleeve port 21, through recirculation groove 7 on the outer diameter of the sleeve 16 to the first spool port 31 and the first central passage 29. The second recirculation path 3*b* (dashed line) is shorter and flows from the first center bolt port 23 and the first sleeve port 17 between spool lands 28*a* and 28*b* to the first central passage 29.

A switchable vent 4 is present to allow fluid to vent from the phaser through the control valve 9.

Source oil 5 is provided to the phaser through the control valve 9 through the third center bolt port 25 and the third sleeve port 19 between spool lands 28*d* and 28*e*, through the fourth spool port 25 to the second central passage 30.

Vent 26 vents the back of the control valve through the center bolt to atmosphere.

In the hydraulic layout of FIG. 1, through the control valve 9, the phaser operates in either CTA only mode or both CTA and TA Mode simultaneously. The selection of the operating mode is spool position dependent. The TA vent 4 is employed at the extreme positions of the control valve, which are at or near the control valve full in or full out positions.

FIG. 2 is an alternate switchable configuration with the introduction of a continuous TA vent 35 at the nose of the spool 28 that is not spool position dependent. The continuous TA vent 35 eliminated the CTA only mode and improved the closed loop control response of the phaser at all operating conditions by employing a continuous mix of CTA and TA modes of operation regardless of spool position. An additional TA mode of the phaser could be used at the end of stroke of the control valve 9 by increasing the TA venting, but the continuous venting did not allow the phaser to enter CTA only mode. The design of the control valve of FIG. 2 employs similar features to those found in FIG. 1 as indicated by the reference numbers.

Although the switchable CTA/TA technologies in FIGS. 1 and 2 provide a measureable increase in hydraulic efficiency over a typical TA-only phaser, they still have some limitations. The first recirculation path 3*a* in one direction is longer and more restrictive than the second recirculation flow path 3*b* in the opposing direction. The recirculation groove 7 between the outer diameter of the sleeve 16 and the bore 8*a* of the center bolt 8 is the source of that restriction. One of the compromises of these designs was the non-symmetrical actuation rates in advance direction versus the retard direction.

Groove 7 receives fluid for recirculation between advance and retard chambers and exhausting of fluid from the advance and retard chambers. Therefore, groove 7 receives all of the fluid required to shift the phaser between positions and has to be large enough to accommodate all of such fluid and not be restrictive.

In addition the constant TA vent 35 in the nose of the spool 28 of the control valve 9 is fixed and identical for both the advance and retard direction of the phaser which removed some ability to tune the actuation rates in the advance and retard direction independent of one another. It would be more desirable to be able to determine the TA venting independently for advance and retard actuation.

SUMMARY OF THE INVENTION

A variable cam timing phaser with a control valve that can selectively user either CTA mode, TA mode or both CTA and TA mode simultaneously to actuate the phaser.

DETAILED DESCRIPTION OF THE INVENTION

Figure 4:
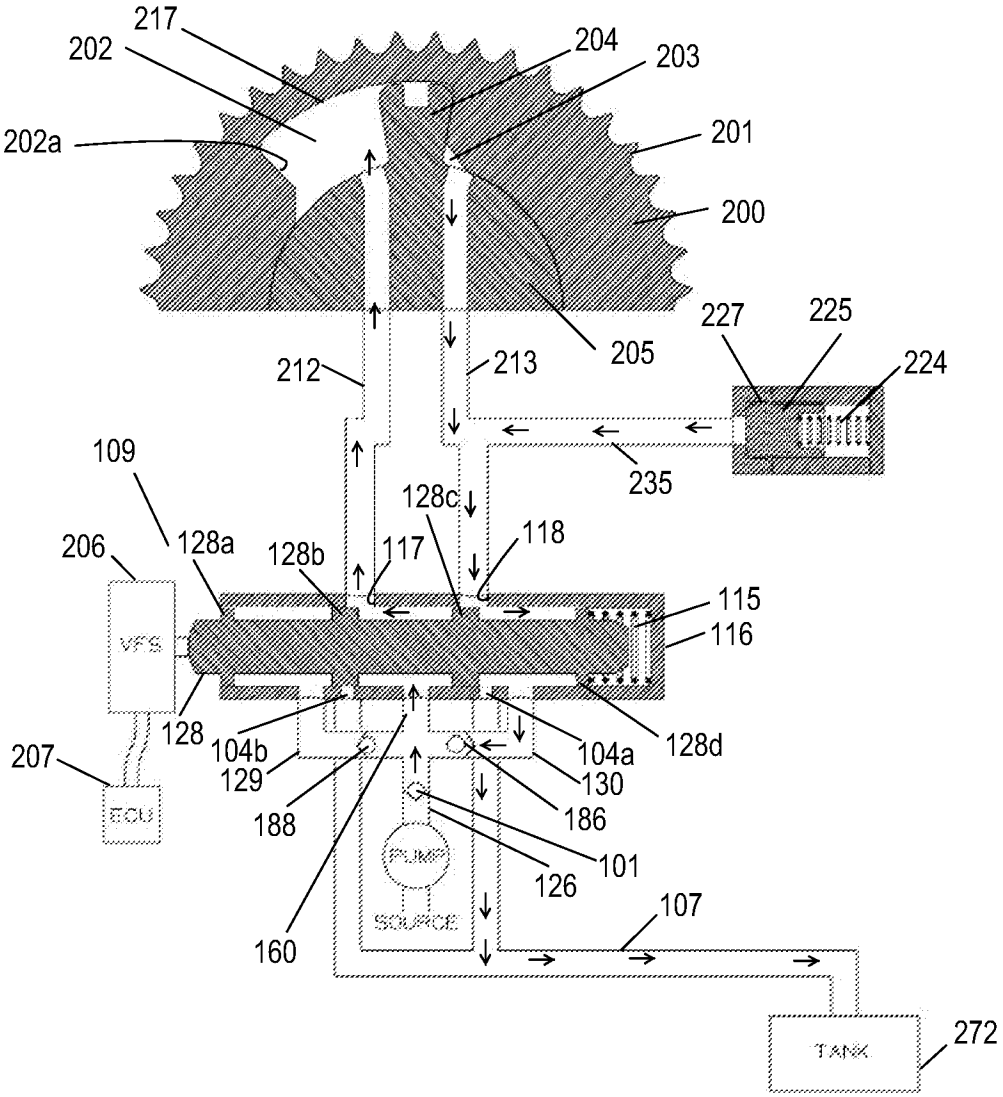
FIG. 4 shows a schematic of a variable cam timing phaser of a first embodiment with a control valve including recirculation check valves and venting in an advance position.
Figure 5:
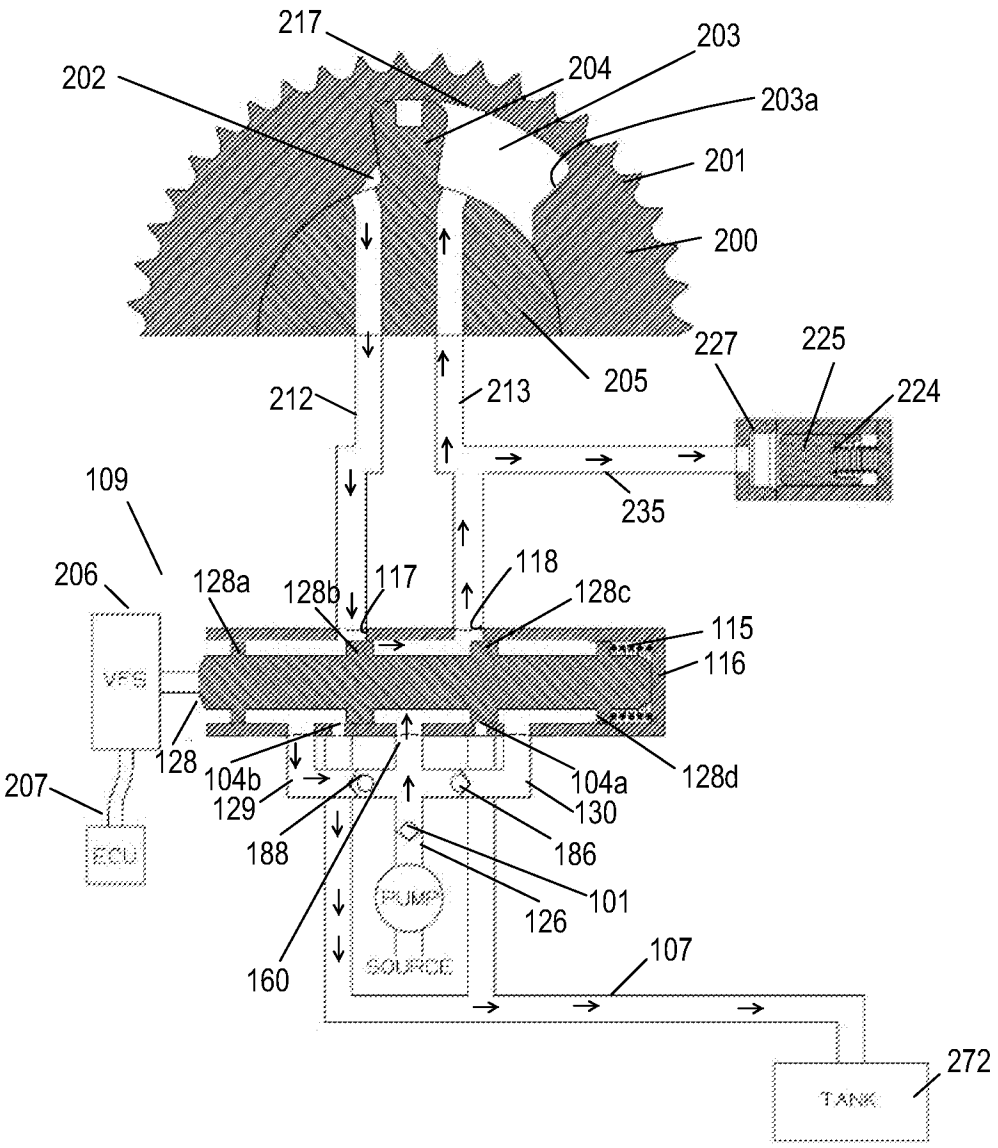
FIG. 5 shows a schematic of a variable cam timing phaser of a first embodiment with a control valve including recirculation check valves and venting in a retard position.
Figure 6:
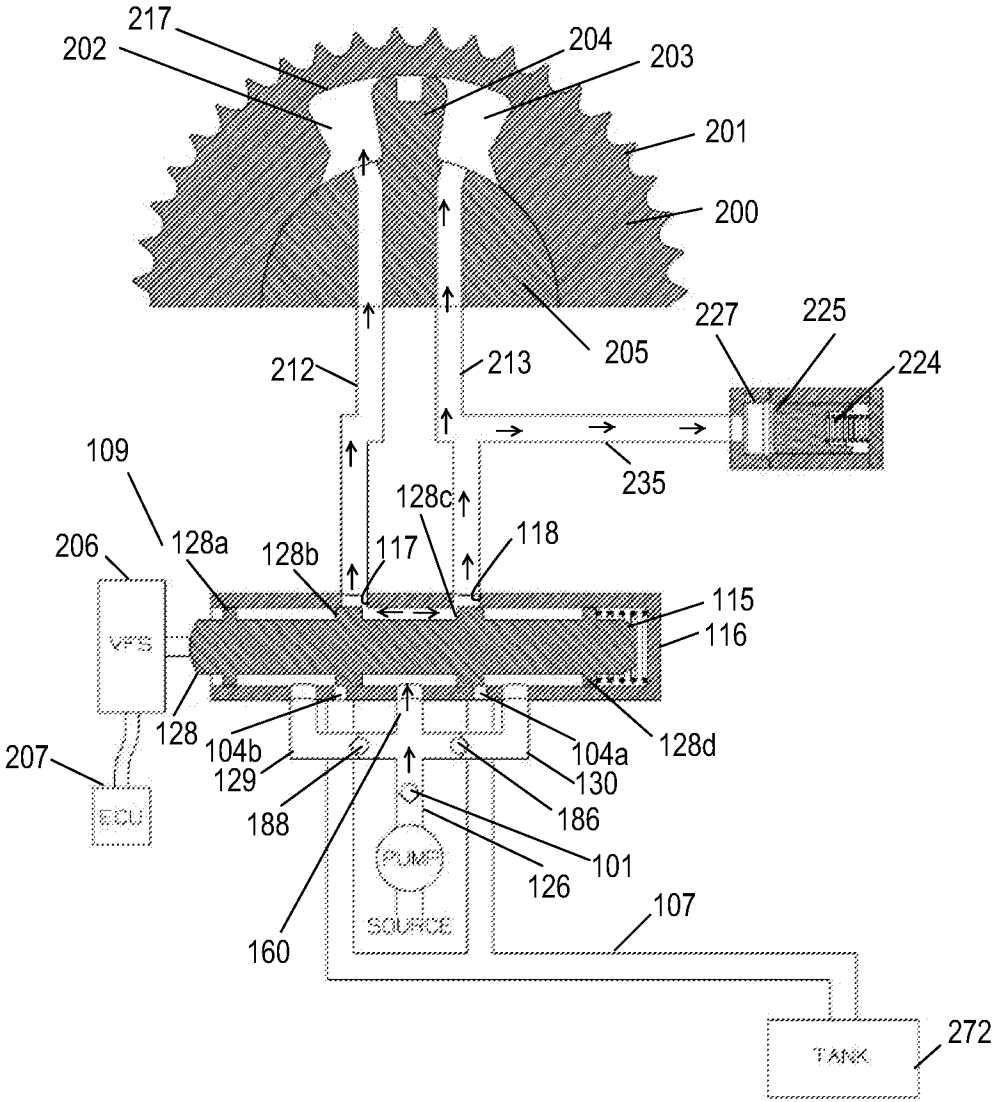
FIG. 6 shows a schematic of a variable cam timing phaser of a first embodiment with a control valve including recirculation check valves and venting in a holding or null position.

FIGS. 4-6 show a variable cam timing phaser of a first embodiment with a control valve including recirculation check valves and spool dependent variable venting.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor assembly 205 with one or more vanes 204, mounted to the end of the camshaft (not shown), surrounded by a housing assembly 200 with the vane chambers into which the vanes fit. It is possible to have the vanes 204 mounted to the housing assembly 200, and the chambers in the rotor assembly 205, as well. The housing's outer circumference 201 forms the sprocket, pulley or gear accepting drive force through a chain, belt, or gears, usually from the crankshaft, or possible from another camshaft in a multiple-cam engine.

The housing assembly 200 of the phaser has an outer circumference 201 for accepting drive force. The rotor assembly 205 is connected to the camshaft and is coaxially located within the housing assembly 200. The rotor assembly 205 has a vane 204 separating a chamber 217 formed between the housing assembly 200 and the rotor assembly 205 into an advance chamber 202 and a retard chamber 203. The chamber 217 has an advance wall 202*a* and a retard wall 203*a*. The vane 204 is capable of rotation to shift the relative angular position of the housing assembly 200 and the rotor assembly 205.

Figure 3A:
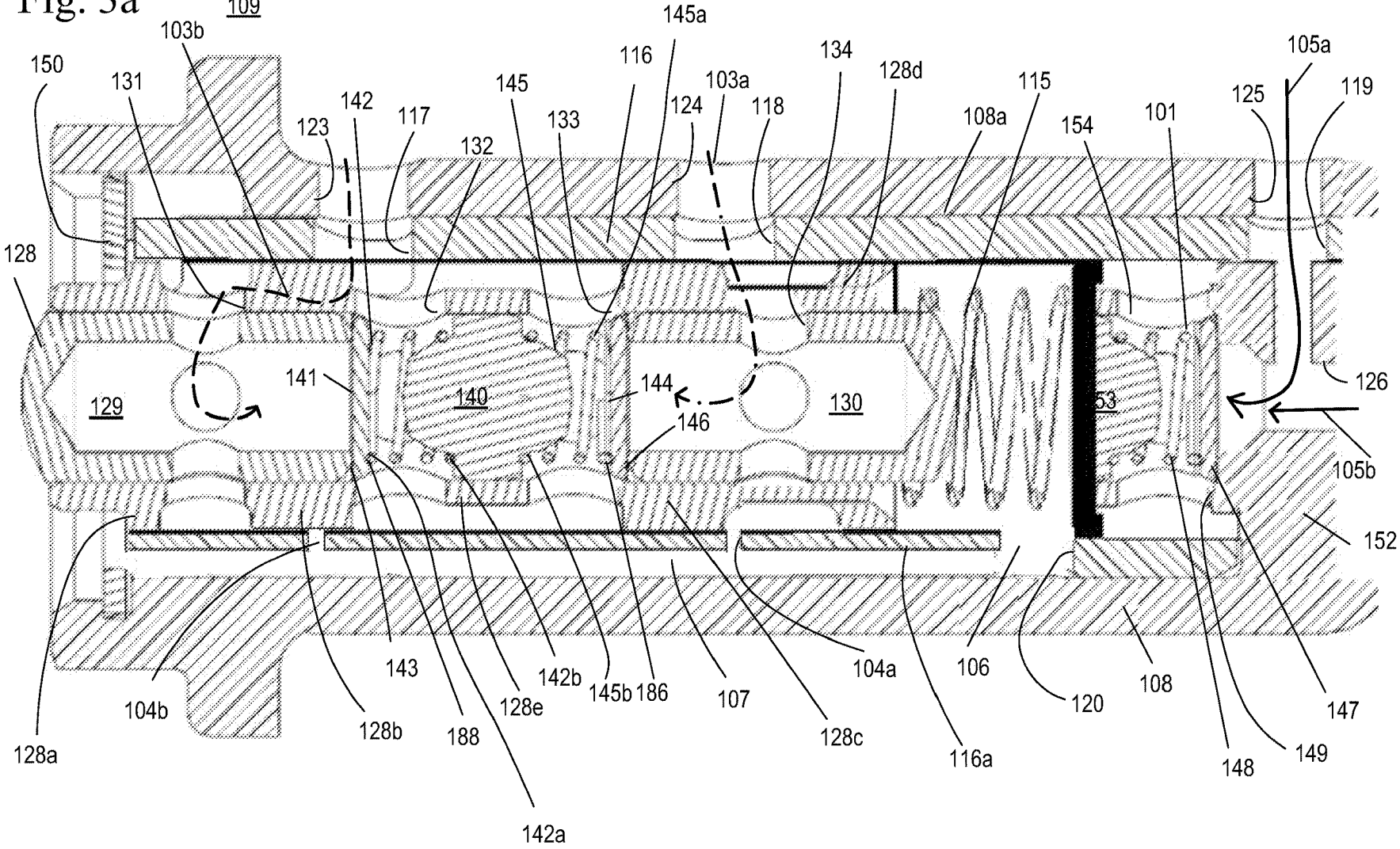
FIG. 3*a* shows a cross-section of a switchable control valve of the present invention with three check valves, two of which are recirculation check valves of a variable cam timing phaser and spool dependent variable vents.
Figure 3B:
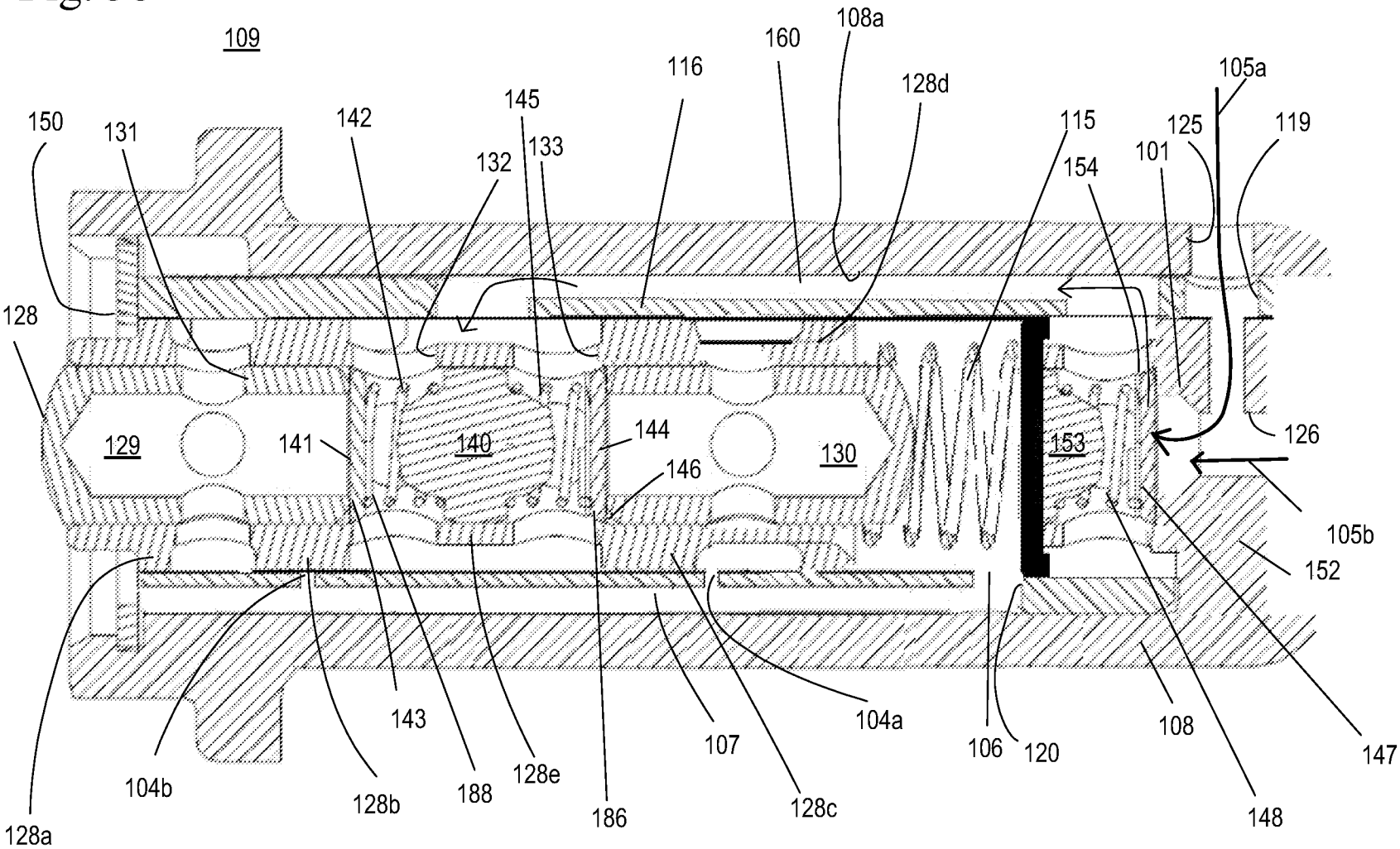
FIG. 3*b* shows another cross-section of a switchable control valve of the present invention with three check valves, two of which are recirculation check valves of a variable cam timing phaser and spool dependent variable vents.

Referring to FIGS. 3*a* and 3*b*, a control valve 109 has a center bolt body 108 defining a center bolt bore 108*a*. Within the bore 108*a* of the center bolt body 108 is a protrusion 152. The center bolt body 108 has a series of center bolt ports 123, 124, 125, 126. The bore 108*a* of the center bolt body 108 receives a sleeve 116. The sleeve 116 is fixed within the bore 108*a* between a washer or retaining ring 150 and the center bolt body protrusion 152. The sleeve 116 has a plurality of sleeve ports 117, 118, 119, 120 and spool dependent variable vents 104*a*, 104*b*. Within the control valve 109, at least a portion of the outer diameter 116*a* of the sleeve 116 and the bore 108*a* of the center bolt body 108 forms a passage or groove 107 and an inlet groove 160. The spool dependent variable vents 104*a* and 104*b* vary as the spool passes relative to the vents in the sleeve 116.

The first center bolt port 123 is aligned with the first sleeve port 117. The second center bolt port 124 is aligned with the second sleeve port 118. The third center bolt port 125 is aligned with the third sleeve port 119. The fourth sleeve port 120 and vents 104*a*, 104*b* are aligned with passage 107 between the bore of the center bolt body 108 and the outer diameter 116*a* of the sleeve 116. The fourth sleeve port 120 defines a vent 106 that is present at the back of the control valve 109.

A spool 128 is slidably received within the sleeve 116 and has a plurality of cylindrical lands 128*a*, 128*b*, 128*c*, 128*d*, 128*e*. Spool ports 131, 132, 133, 134 are present between lands 128*a*-128*e* of the spool. The spool contains a first internal passage 129, a second internal passage 130 and two recirculation check valves 188 and 186 between the first and second internal passages 129, 130.

The first recirculation check valve 188 has disk 141 which is spring 142 biased to seat on a spool seat 143. The first end 142*a* of the spring 142 is in contact with the disk 141 and the second end 142*b* of the spring 142 contacts a check valve base 140 between spool lands 128*b* and 128*c* in line with spool land 128*e*. Fluid can pass in one direction through the first recirculation check valve 188 by flowing through the first internal passage 129, biasing the disk 141 off of or away from the spool seat 143 against the force of the spring 142 such that fluid can exit out spool port 132.

The second recirculation check valve 186 has disk 144 which is spring 145 biased to seat on a spool seat 146. The first end 145*a* of the spring 145 is in contact with the disk 144 and the second end 145*b* of the spring 145 contacts a check valve base 140 between spool lands 128*b* and 128*c* in line with spool land 128*e*. Fluid can pass in one direction through the second recirculation check valve 186 by flowing through the second internal passage 130, biasing the disk 144 off of or away from the spool seat 146 against the force of the spring 145 such that fluid can exit out spool port 133.

The first and second recirculation check valves 186, 188 act independent of one another. The term "independent" meaning that the first recirculation check valve 188 is controllable or adjustable separately from the second recirculation check valve 186.

The spool 128 is biased outwards or towards the retaining ring 150 by a spring 115. An actuator 206 such as a pulse width modulated variable force solenoid (VFS), applies a force on the spool 128 to bias the spool 128 inwards or towards the center bolt body protrusion 152. The solenoid may also be linearly controlled by varying current or voltage or other methods as applicable. A first end of the spring 115*a* engages the spool 128 and a second end 115*b* of the spring 115 engages an insert 160.

The position of the control valve 109 is controlled by an engine control unit (ECU) 207 which controls the duty cycle of the variable force solenoid 206. The ECU 207 preferably includes a central processing unit (CPU) which runs various computational processes for controlling the engine, memory, and input and output ports used to exchange data with external devices and sensors.

The position of the spool 128 is influenced by spring 115 and the solenoid 206 controlled by the ECU 207. Further detail regarding control of the phaser is discussed in detail below. The position of the spool 128 controls the motion (e.g. to move towards the advance position, holding position, or the retard position) of the phaser.

Between the insert 160 and the center bolt body protrusion 152 is an inlet check valve 101. The inlet check valve 101 includes a disk 147 which is spring 148 biased to seat on a seat 149 formed on the center bolt body protrusion 152. The first end 148*a* of the spring 148 is in contact with the disk 147 and the second end 148*b* of the spring 148 contacts a check valve base 153 adjacent insert 160. Fluid can pass in one direction through the inlet check valve 101 by flowing through a center bolt port 126, biasing the disk 147 off of or away from the seat 149 against the force of the spring 148 such that fluid can exit out a check valve port 154.

While the recirculation check valves 186, 188 and the inlet check valve 101 are shown as a disk check valve, although other check valves such as ball check or band check valve may also be used.

The control valve 109 has a first recirculation path 103*a* and a second recirculation path 103*b*. The first recirculation path 103*a* is to recirculation fluid from the retard chamber 203 to the advance chamber 202. The first recirculation path 103*a* is as follows. Fluid flows from the second sleeve port 118 in fluid communication with the retard chamber 203 to the fourth spool port 134 between spool lands 128*c* and 128*d* to the second internal passage 130. From the second internal passage 130, fluid flows through the second recirculation check valve 186, exits the second recirculation check valve 186 through the third spool port 133 and flows to the advance chamber 202 through the first sleeve port 117.

The second recirculation path 103*b* is to recirculate fluid from the advance chamber 202 to the retard chamber 203. The second recirculation path 103*b* is as follows. Fluid flows from the first sleeve port 117 in fluid communication with the advance chamber 202 to the first spool port 131 between spool lands 128*a* and 128*b* to the first internal passage 129. From the first internal passage 129, fluid flows through the first recirculation check valve 188, exits the first recirculation check valve 188 through the second spool port 132 and flows to the retard chamber 203 through the second sleeve port 118.

The "distance" traveled by the fluid to recirculate between the advance and retard chambers 202, 203 is approximately equal. The recirculation path is independent from venting of fluid from the control valve 109.

In the position shown in FIGS. 3*a* and 3*b*, a spool out position, the spool is positioned within the sleeve as follows. The first spool port 131 between spool lands 128*a* and 128*b* is blocked by the sleeve 116. The second spool port 132 and the output of the first recirculation check valve 188 is open to fluid communication with the first sleeve port 117 between the spool land 128*b* and 128*e* and the first center bolt port 123. The third spool port 133 and the output of the second recirculation check valve 186 is open to fluid communication with the first sleeve port 117 between spool land 128 and 128*c* and the first center bolt port 123. The fourth spool port 134 is between spool lands 128*c* and 128*d* and is in fluid communication with the second internal passage 130 and vent 104*a* of the sleeve 116.

It should be noted that the second recirculation path 103*b* is shown for illustration purposes, but would not be present during operation of the control valve in this position.

Fluid from a source is shown as entering either through third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to groove or passage 160 between the center bolt housing 108 and the outer diameter of the sleeve 116.

It should be noted that the center bolt body 108 has been removed from FIGS. 4-6 for clarity purposes.

Referring back to FIG. 4, the phaser is moving towards an advance position, the duty cycle is adjusted to a range of 0-50% the force of the VFS 206 on the spool 128 is changed and the spool 128 is moved to the left in an advance mode in the figure by spring 115, until the force of the VFS 206 balances the force of the spring 115. Fluid exits from the retard chamber 203 through the retard line 213 to the second center bolt port 124 and the second sleeve port 118. From the second sleeve port 118, fluid flows between spool lands 128*c* and 128*d* to the second internal passage 130. From the second internal passage 130, fluid flows through the second recirculation check valve 186, through the third spool port 133 to the first sleeve port 117 and the first center bolt port 123 to the advance line 212. Fluid flowing through the second recirculation check valve 186 recirculates between the retard chamber 203 and the advance chamber 202 (first recirculation path 103*a*). Fluid exiting from the retard line 213 to the second internal passage 130 additionally flows through the spool dependent variable vent 104*a* of the sleeve 116. From the spool dependent variable vent 104*a*, fluid flows through passage 107 to exit the control valve 109 and flow to tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to groove or passage 160 between the center bolt housing 108 and the outer diameter of the sleeve 116 and to the advance line 212.

Since the retard line 213 can vent to tank 272, fluid pressure in line 235 connected to the retard line 213 is not great enough to move the lock pin 225 against the force of the lock pin spring 224 and therefore, the spring force is great enough to move the lock pin 225 into engagement with a recess 227 in the housing assembly 200, locking the position of the housing assembly 200 relative to the rotor assembly 205.

It should be noted that the amount of fluid which vents through spool dependent variable vent 104*a* and the amount of fluid that recirculates to the advance chamber 202 through the second recirculation check valve 186 is based on the size of the spool dependent variable vent 104*a* itself and the width of the spool land. If the spool dependent variable vent 104*a* is very small or restricted by the spool 128, more fluid will recirculate from the retard chamber 203 to the advance chamber 202 and the phaser will function more similarly to a cam torque actuated phaser. If the spool dependent variable vent 104*a* is large, the phaser will function more similarly to a torsion assisted phaser.

FIG. 5 shows the phaser is moving towards a retard position, the duty cycle is adjusted to a range of 50-100% the force of the VFS 206 on the spool 128 is changed and the spool 128 is moved to the right in a retard mode in the figure by actuator 206 until the force of the VFS 206 balances the force of the spring 115. Fluid exits from the advance chamber 202 through the advance line 212 to the first center bolt port 123 and the first sleeve port 117. From the first sleeve port 117, fluid flows between spool lands 128*a* and 128*b* to the first internal passage 129. From the first internal passage 129, fluid flows through the first recirculation check valve 188, through the second spool port 132 to the second sleeve port 118 and the second center bolt port 124 to the retard line 213. Fluid flowing through the first recirculation check valve 188 recirculates between the advance chamber 202 and the retard chamber 203 (second recirculation path 103*b*). Fluid exiting from the advance line 212 to the first internal passage 129 additionally flows through spool dependent variable vent 104*b* of the sleeve 116. From the spool dependent variable vent 104*b* fluid flows through passage 107 to exit the control valve 109 and flow to tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to passage or groove 160 and to the retard line 213.

Since fluid is being supplied to the retard line 213 and thus line 235, the fluid pressure in line 235 is great enough to move the lock pin 225 against the force of the lock pin spring 224 and therefore, move the lock pin 225 out of engagement with recess 227 in the housing assembly 200, allowing the rotor assembly 205 to move relative to the housing assembly 200.

It should be noted that the amount of fluid which vents through spool dependent variable vent 104*b* and the amount of fluid that recirculates to the retard chamber 203 through the first recirculation check valve 188 is based on the size of the spool dependent variable vent 104*b* itself and the width of the spool land. If the spool dependent variable vent 104*b* is very small or restricted by the spool 128, more fluid will recirculate from the advance chamber 202 to the retard chamber 203 and the phaser will function more similarly to a cam torque actuated phaser. If the spool dependent variable vent 104*b* us large, the phaser will function more similarly to a torsion assisted phaser.

FIG. 6 shows the phaser in the holding position. In this position, the duty cycle of the variable force solenoid 207 is approximately 50% and the force of the VFS 206 on one end of the spool 128 equals the force of the spring 115 on the opposite end of the spool 128 in holding mode. The spool land 128*b* mostly blocks the flow of fluid from advance line 212 and spool land 128*c* mostly blocks the flow of fluid from the retard line 213. Makeup oil is supplied to the phaser from supply S by pump source 226 to make up for leakage and passes through the inlet check valve 101. From the inlet check valve out 154, fluid flows to the passage 160, and flows to the advance line 212 and the retard line 213. Since the retard line 213 contains fluid, the lock pin 225 is in an unlocked position. The spool dependent variable vents 104*a*, 104*b* are blocked by spool lands 128*b*, 128*c* from venting fluid to tank 272.

Figure 7:
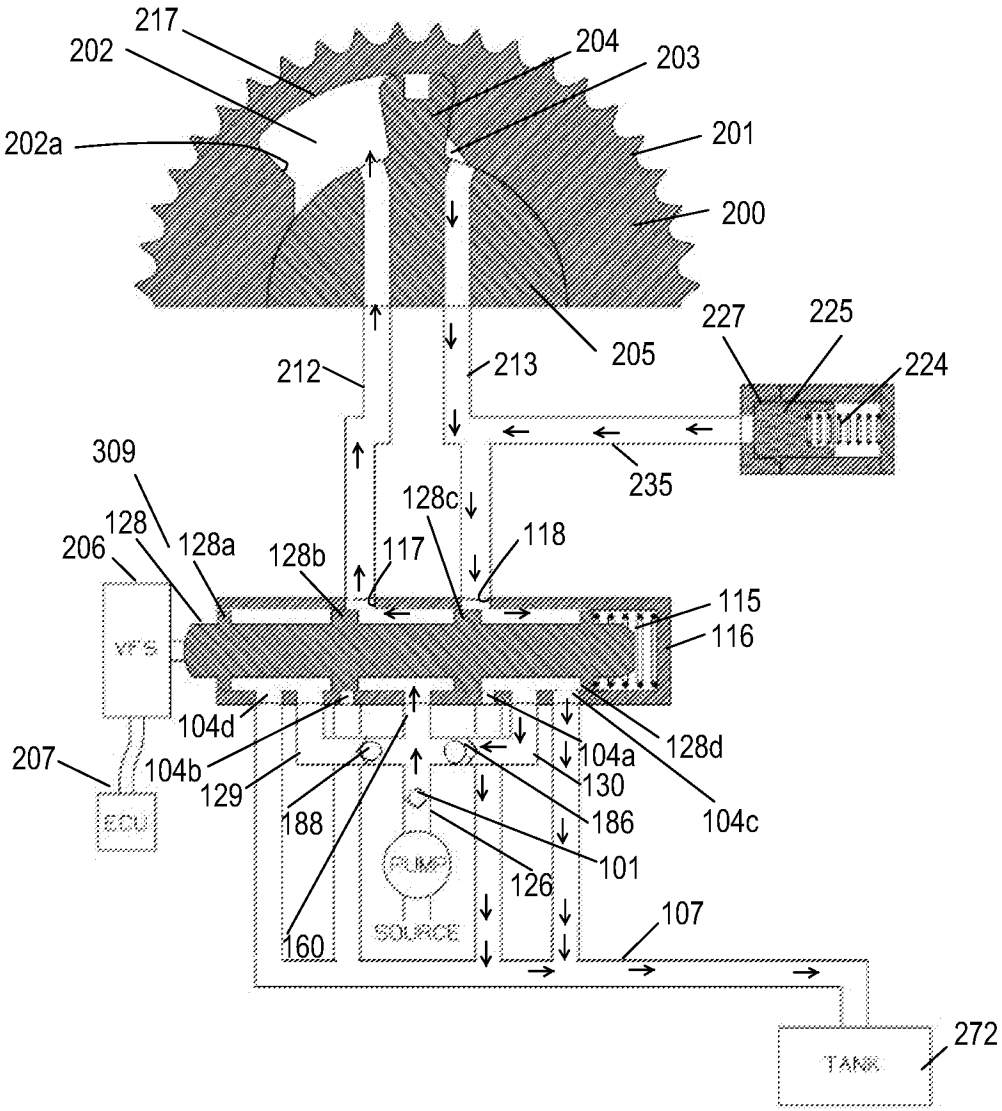
FIG. 7 shows a schematic of a variable cam timing phaser of a second embodiment with a control valve including recirculation check valves and venting in an advance position.
Figure 8:
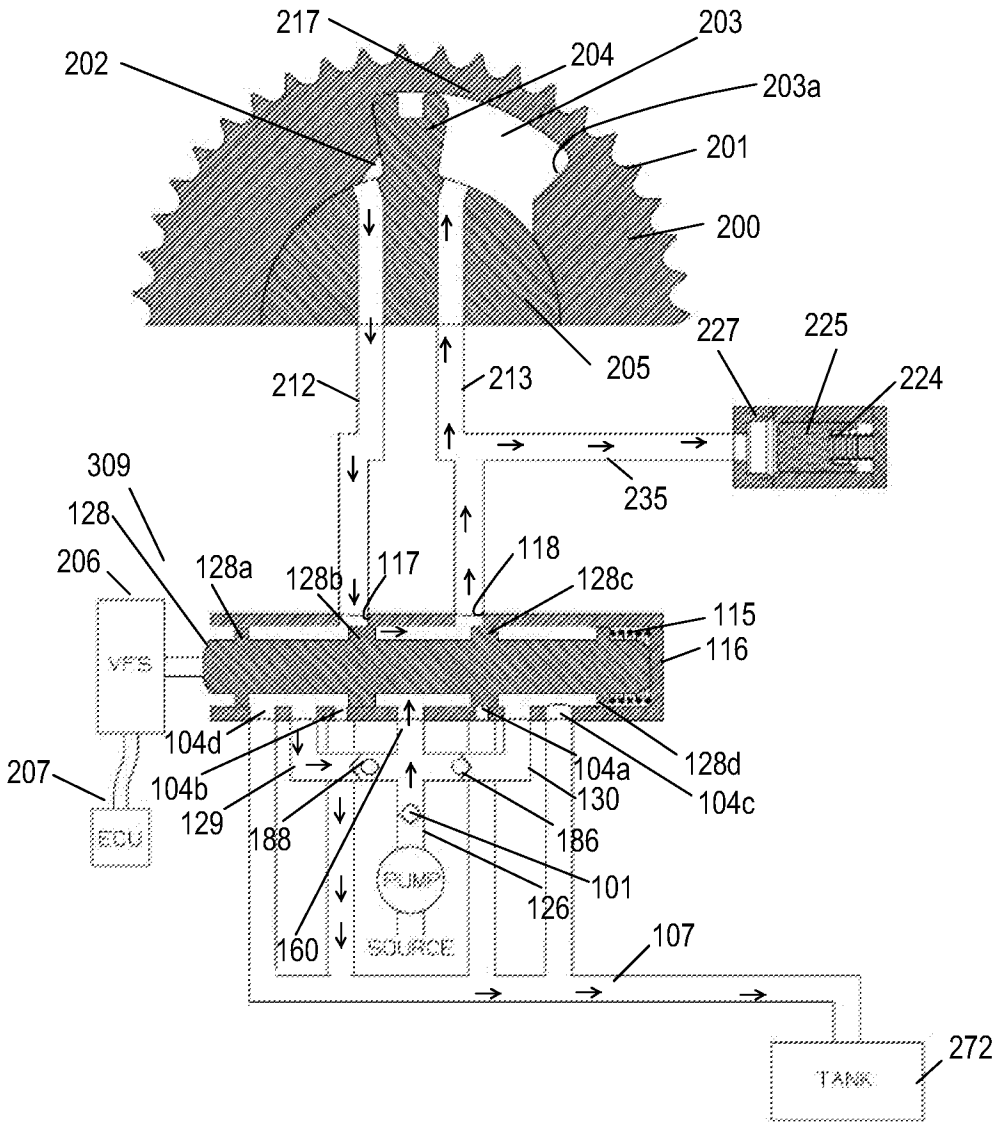
FIG. 8 shows a schematic of a variable cam timing phaser of a second embodiment with a control valve including recirculation check valves and venting in a retard position.
Figure 9:
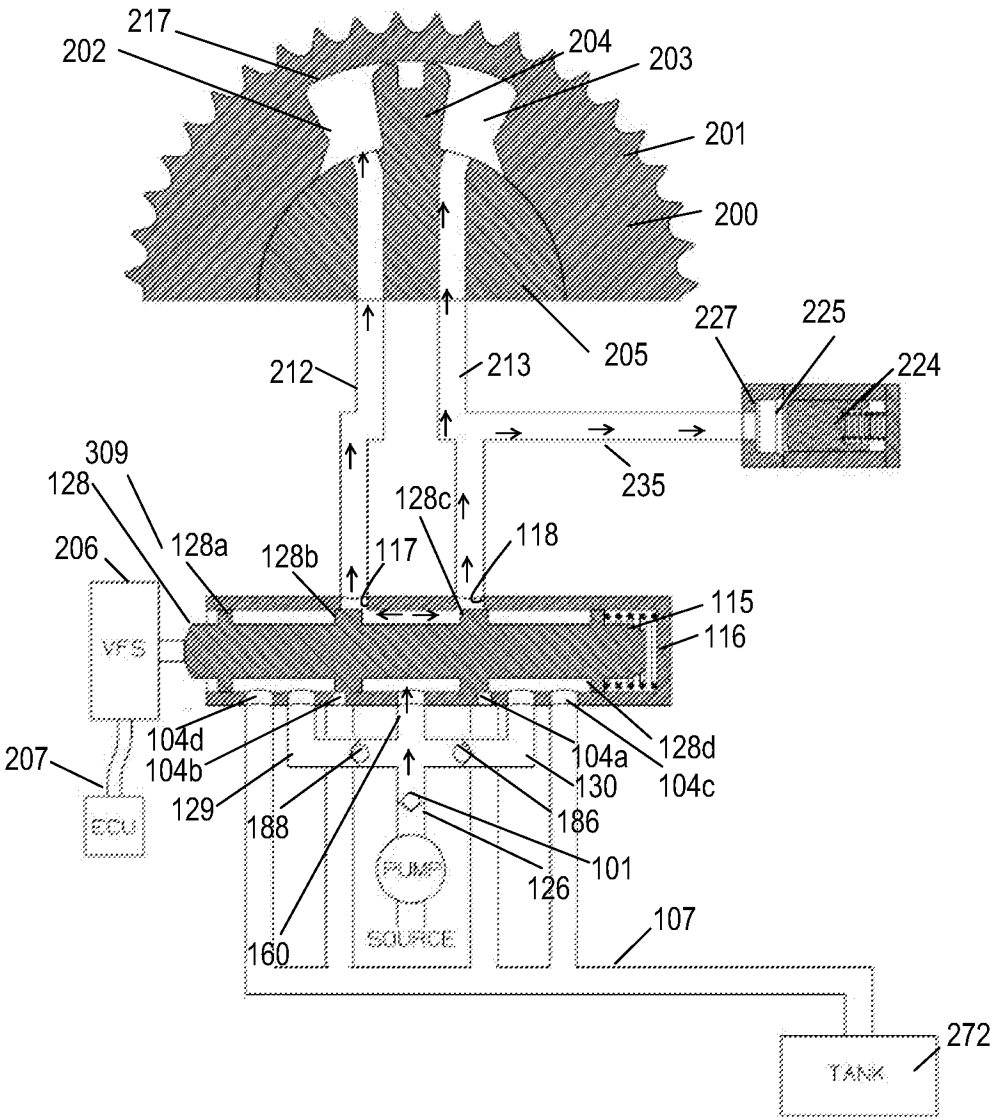
FIG. 9 shows a schematic of a variable cam timing phaser of a second embodiment with a control valve including recirculation check valves and venting in a holding or null position.
Figure 11A:
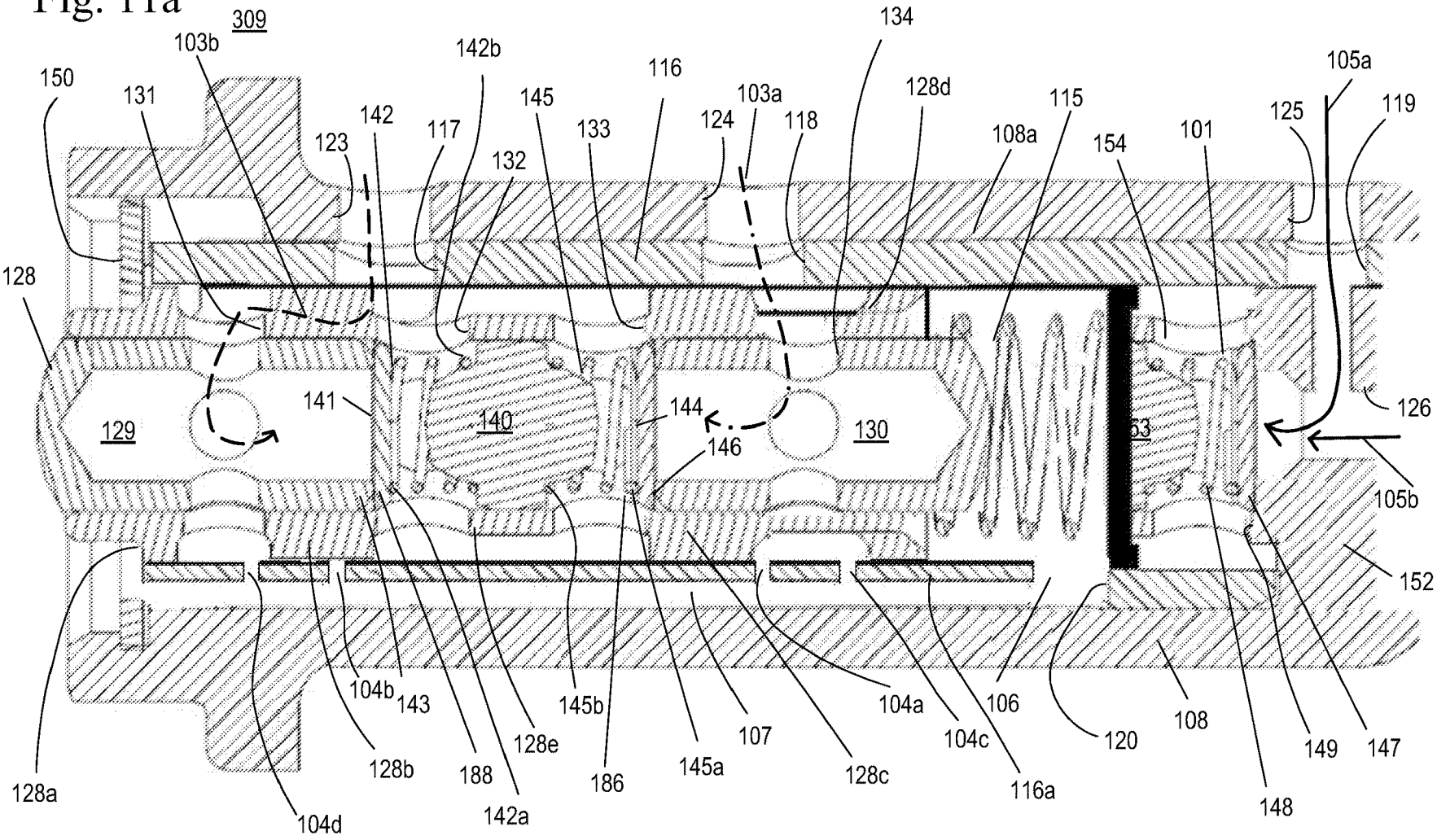
FIG. 11*a* shows a cross-section of an alternate switchable control valve of the present invention with three check valves, two of which are recirculation check valves of a variable cam timing phaser, constant vents, and spool dependent variable vents.
Figure 11B:
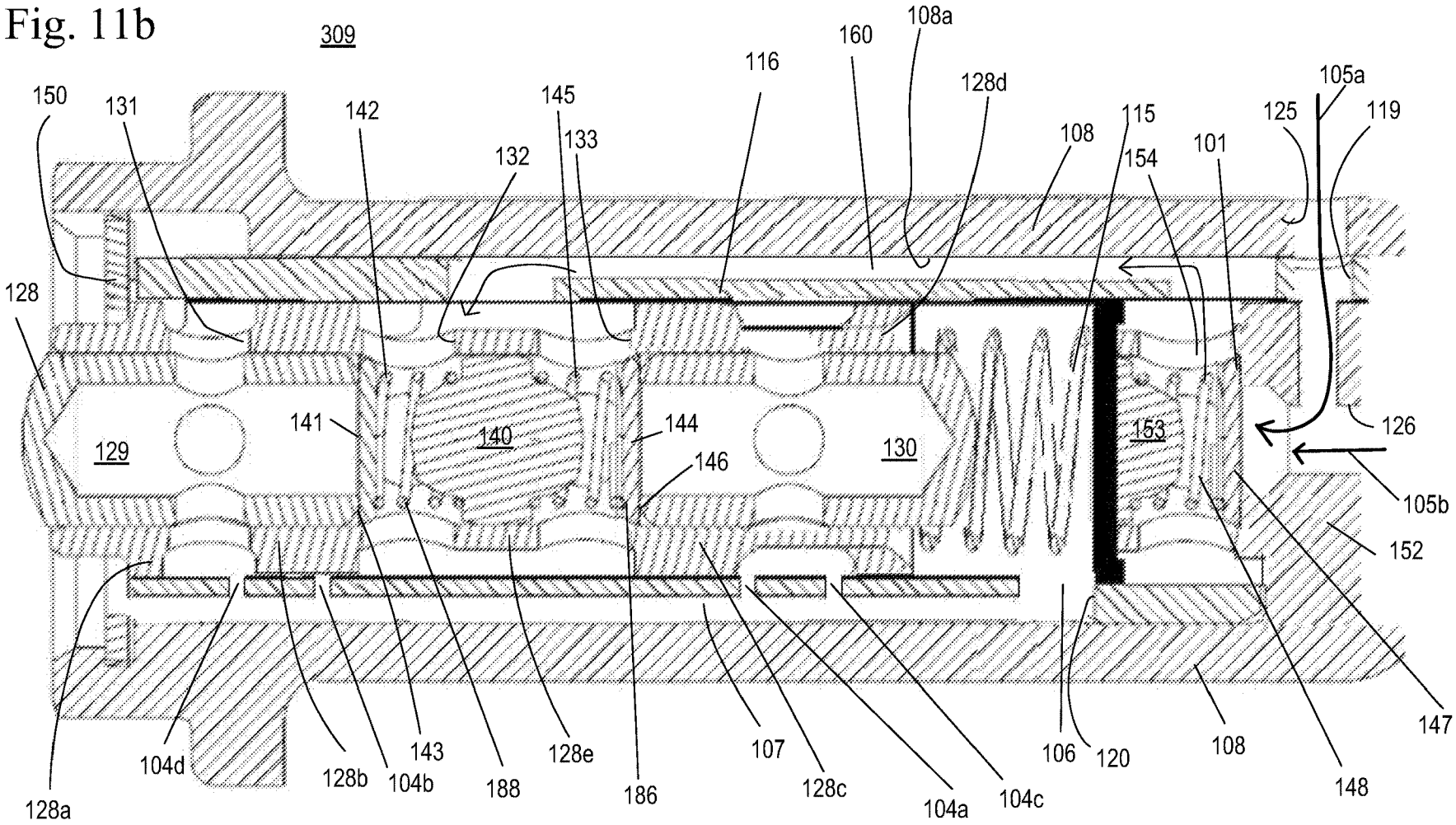
FIG. 11*b* shows another cross-section of an alternate switchable control valve of the present invention with three check valves, two of which are recirculation check valves of a variable cam timing phaser, constant vents, and spool dependent variable vents.

FIGS. 7-9 show a variable cam timing phaser of a second embodiment with a control valve including recirculation check valves, constant, continuous venting, and variable venting. FIGS. 11*a* and 11*b* show the corresponding control valve 309.

The difference between the phaser of the first embodiment shown in FIGS. 4-6 and the phaser of the second embodiment is the additional continuous vents 104*d* and 104*c* present in the present in the sleeve 116.

Referring to FIGS. 11*a* and 11*b*, a control valve 309 has a center bolt body 108 defining a center bolt bore 108*a*. Within the bore 108*a* of the center bolt body 108 is a protrusion 152. The center bolt body 108 has a series of center bolt ports 123, 124, 125, 126. The bore 108*a* of the center bolt body 108 receives a sleeve 116. The sleeve 116 is fixed within the bore 108*a* between a washer or retaining ring 150 and the center bolt body protrusion 152. The sleeve 116 has a plurality of sleeve ports 117, 118, 119, 120 and vents 104*a*, 104*b*, 104*c*, 104*d*. Within the control valve 109, at least a portion of the outer diameter 116*a* of the sleeve 116 and the bore 108*a* of the center bolt body 108 forms a passage or groove 107 and an inlet groove 160. The vents 104*d* and 104*c* are of a constant size and continuously vent fluid. Vents 104*a* and 104*b* are spool dependent and therefore variable in size. As the spool 128 moves, the size of the vents 104*b* and 104*a* are opened and closed by the spool lands 128*b* and 128*c*, respectively.

The first center bolt port 123 is aligned with the first sleeve port 117. The second center bolt port 124 is aligned with the second sleeve port 118. The third center bolt port 125 is aligned with the third sleeve port 119. The fourth sleeve port 120 and vents 104*a*, 104*b*, 104*c*, 104*d* are aligned with passage 107 between the bore of the center bolt body 108 and the outer diameter 116*a* of the sleeve 116. The fourth sleeve port 120 defines a vent 106 that is present at the back of the control valve 109.

A spool 128 is slidably received within the sleeve 116 and has a plurality of cylindrical lands 128*a*, 128*b*, 128*c*, 128*d*, 128*e*. Spool ports 131, 132, 133, 134 are present between lands 128*a*-128*e* of the spool. The spool contains a first internal passage 129, a second internal passage 130 and two recirculation check valves 188 and 186 between the first and second internal passages 129, 130.

The first recirculation check valve 188 has disk 141 which is spring 142 biased to seat on a spool seat 143. The first end 142*a* of the spring 142 is in contact with the disk 141 and the second end 142*b* of the spring 142 contacts a check valve base 140 between spool lands 128*b* and 128*c* in line with spool land 128*e*. Fluid can pass in one direction through the first recirculation check valve 188 by flowing through the first internal passage 129, biasing the disk 141 off of or away from the spool seat 143 against the force of the spring 142 such that fluid can exit out spool port 132.

The second recirculation check valve 186 has disk 144 which is spring 145 biased to seat on a spool seat 146. The first end 145*a* of the spring 145 is in contact with the disk 144 and the second end 145*b* of the spring 145 contacts a check valve base 140 between spool lands 128*b* and 128*c* in line with spool land 128*e*. Fluid can pass in one direction through the second recirculation check valve 186 by flowing through the second internal passage 130, biasing the disk 144 off of or away from the spool seat 146 against the force of the spring 145 such that fluid can exit out spool port 133.

The first and second recirculation check valves 186, 188 act independent of one another. The term "independent" meaning that the first recirculation check valve 188 is controllable or adjustable separately from the second recirculation check valve 186.

The spool 128 is biased outwards or towards the retaining ring 150 by a spring 115. An actuator 206 such as a pulse width modulated variable force solenoid (VFS), applies a force on the spool 128 to bias the spool 128 inwards or towards the center bolt body protrusion 152. The solenoid may also be linearly controlled by varying current or voltage or other methods as applicable. A first end of the spring 115*a* engages the spool 128 and a second end 115*b* of the spring 115 engages an insert 160.

The position of the control valve 309 is controlled by an engine control unit (ECU) 207 which controls the duty cycle of the variable force solenoid 206. The ECU 207 preferably includes a central processing unit (CPU) which runs various computational processes for controlling the engine, memory, and input and output ports used to exchange data with external devices and sensors.

The position of the spool 128 is influenced by spring 115 and the solenoid 206 controlled by the ECU 207. Further detail regarding control of the phaser is discussed in detail below. The position of the spool 128 controls the motion (e.g. to move towards the advance position, holding position, or the retard position) of the phaser.

Between the insert 160 and the center bolt body protrusion 152 is an inlet check valve 101. The inlet check valve 101 includes a disk 147 which is spring 148 biased to seat on a seat 149 formed on the center bolt body protrusion 152. The first end 148*a* of the spring 148 is in contact with the disk 147 and the second end 148*b* of the spring 148 contacts a check valve base 153 adjacent insert 160. Fluid can pass in one direction through the inlet check valve 101 by flowing through a center bolt port 126, biasing the disk 147 off of or away from the seat 149 against the force of the spring 148 such that fluid can exit out a check valve port 154.

While the recirculation check valves 186, 188 and the inlet check valve 101 are shown as a disk check valve, although other check valves such as ball check or band check valve may also be used.

The control valve 309 has a first recirculation path 103*a* and a second recirculation path 103*b*. The first recirculation path 103*a* is to recirculation fluid from the retard chamber 203 to the advance chamber 202. The first recirculation path 103*a* is as follows. Fluid flows from the second sleeve port 118 in fluid communication with the retard chamber 203 to the fourth spool port 134 between spool lands 128*c* and 128*d* to the second internal passage 130. From the second internal passage 130, fluid flows through the second recirculation check valve 186, exits the second recirculation check valve 186 through the third spool port 133 and flows to the advance chamber 202 through the first sleeve port 117.

The second recirculation path 103*b* is to recirculate fluid from the advance chamber 202 to the retard chamber 203. The second recirculation path 103*b* is as follows. Fluid flows from the first sleeve port 117 in fluid communication with the advance chamber 202 to the first spool port 131 between spool lands 128*a* and 128*b* to the first internal passage 129. From the first internal passage 129, fluid flows through the first recirculation check valve 188, exits the first recirculation check valve 188 through the second spool port 132 and flows to the retard chamber 203 through the second sleeve port 118.

The "distance" traveled by the fluid to recirculate between the advance and retard chambers 202, 203 is approximately equal. The recirculation path is independent from venting of fluid from the control valve 309.

In the position shown in FIGS. 11*a* and 11*b*, a spool out position, the spool 128 is positioned within the sleeve 116 as follows. The first spool port 131 between spool lands 128*a* and 128*b* is aligned with spool constant vent 104*d* and is in fluid communication with the first internal passage 129. The second spool port 132 and the output of the first recirculation check valve 188 is open to fluid communication with the first sleeve port 117 between the spool land 128*b* and 128*e* and the first center bolt port 123. The third spool port 133 and the output of the second recirculation check valve 186 is open to fluid communication with the first sleeve port 117 between spool land 128 and 128*c* and the first center bolt port 123. The fourth spool port 134 is between spool lands 128*c* and 128*d* and is in fluid communication with the second internal passage 130 and spool dependent variable vent 104*a*, constant vent 104*c*, sleeve port 118, and center bolt port 124.

It should be noted that the second recirculation path 103*b* is shown for illustration purposes, but would not be present during operation of the control valve in this position.

Fluid from a source is shown as entering either through third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to groove or passage 160 between the center bolt housing 108 and the outer diameter of the sleeve 116.

FIG. 7 shows the phaser is moving towards an advance position, the duty cycle is adjusted to a range of 0-50% the force of the VFS 206 on the spool 128 is changed and the spool 128 is moved to the left in an advance mode in the figure by spring 115, until the force of the VFS 206 balances the force of the spring 115. Fluid exits from the retard chamber 203 through the retard line 213 to the second center bolt port 124 and the second sleeve port 118. From the second sleeve port 118, fluid flows between spool lands 128*c* and 128*d* to the second internal passage 130. From the second internal passage 130, fluid flows through the second recirculation check valve 186, through the third spool port 133 to the first sleeve port 117 and the first center bolt port 123 to the advance line 212. Fluid flowing through the second recirculation check valve 186 recirculates between the retard chamber 203 and the advance chamber 202 (first recirculation path 103*a*). Fluid exiting from the retard line 213 to the second internal passage 130 additionally flows through a variable vent 104*a* and a constant vent 104*c* of the sleeve 116. Fluid flowing out the spool dependent variable vent 104*a* flows through passage 107 to exit the control valve 109 and flow to tank 272. Fluid flowing out of the constant vent 104*c* flows to passage 107 and tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to passage 160 and to the advance line 212.

Since the retard line 213 can vent to tank 272, fluid pressure in line 235 connected to the retard line 213 is not great enough to move the lock pin 225 against the force of the lock pin spring 224 and therefore, the spring force is great enough to move the lock pin 225 into engagement with a recess 227 in the housing assembly 200, locking the position of the housing assembly 200 relative to the rotor assembly 205.

It should be noted that the amount of fluid which vents through spool dependent variable vent 104*a* and constant vent 104*c* and the amount of fluid that recirculates to the advance chamber 202 through the second recirculation check valve 186 is based on the size of the spool dependent variable vent 104*a* and the constant vent 104*c*. If the vent 104*a*, 104*c* is very small or restricted, more fluid will recirculate from the retard chamber 203 to the advance chamber 202 and the phaser will function more similarly to a cam torque actuated phaser. If the vent 104*a*, 104*c* is large, the phaser will function more similarly to a torsion assisted phaser.

FIG. 8 shows the phaser is moving towards a retard position, the duty cycle is adjusted to a range of 50-100% the force of the VFS 206 on the spool 128 is changed and the spool 128 is moved to the right in retard mode in the figure by actuator 206 until the force of the VFS 206 balances the force of the spring 115. Fluid exits from the advance chamber 202 through the advance line 212 to the first center bolt port 123 and the first sleeve port 117. From the first sleeve port 117, fluid flows between spool lands 128*a* and 128*b* to the first internal passage 129. From the first internal passage 129, fluid flows through the first recirculation check valve 188, through the second spool port 132 to the second sleeve port 118 and the second center bolt port 124 to the retard line 213. Fluid flowing through the first recirculation check valve 188 recirculates between the advance chamber 202 and the retard chamber 203 (second recirculation path 103*b*). Fluid exiting from the advance line 212 to the first internal passage 129 additionally flows through spool dependent variable vent 104*b* of the sleeve 116 and constant vent 104*d* of the sleeve 116. From the spool dependent variable vent 104*b* fluid flows through passage 107 to exit the control valve 109 and flow to tank 272. Fluid flowing out the spool dependent variable 104*b* fluid flows through passage 107 to exit the control valve 109 and flow to tank 272. Fluid flowing out of the constant vent 104*d* flows to passage 107 and tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to passage 160 and the retard line 213.

Since fluid is being supplied to the retard line 213 and thus line 235, the fluid pressure in line 235 is great enough to move the lock pin 225 against the force of the lock pin spring 224 and therefore, move the lock pin 225 out of engagement with recess 227 in the housing assembly 200, allowing the rotor assembly 205 to move relative to the housing assembly 200.

It should be noted that the amount of fluid which vents through spool dependent variable vent 104*b* and constant vent 104*d* and the amount of fluid that recirculates to the advance chamber 202 through the second recirculation check valve 186 is based on the size of the spool dependent variable vent 104*b* and the constant vent 104*d*. If the vent 104*b*, 104*d* is very small or restricted, more fluid will recirculate from the retard chamber 203 to the advance chamber 202 and the phaser will function more similarly to a cam torque actuated phaser. If the vent 104*b*, 104*d* is large, the phaser will function more similarly to a torsion assisted phaser.

FIG. 9 shows the phaser in the holding position. In this position, the duty cycle of the variable force solenoid 207 is approximately 50% and the force of the VFS 206 on one end of the spool 128 equals the force of the spring 115 on the opposite end of the spool 128 in holding mode. The spool land 128*b* mostly blocks the flow of fluid from advance line 212 and spool land 128*c* mostly blocks the flow of fluid from the retard line 213. Makeup oil is supplied to the phaser from supply S by pump source 226 to make up for leakage and passes through the inlet check valve 101. From the inlet check valve out 154, fluid flows to passage 160, and flows to the advance line 212 and the retard line 213. Since the retard line 213 contains fluid, the lock pin 225 is in an unlocked position.

Figure 10:
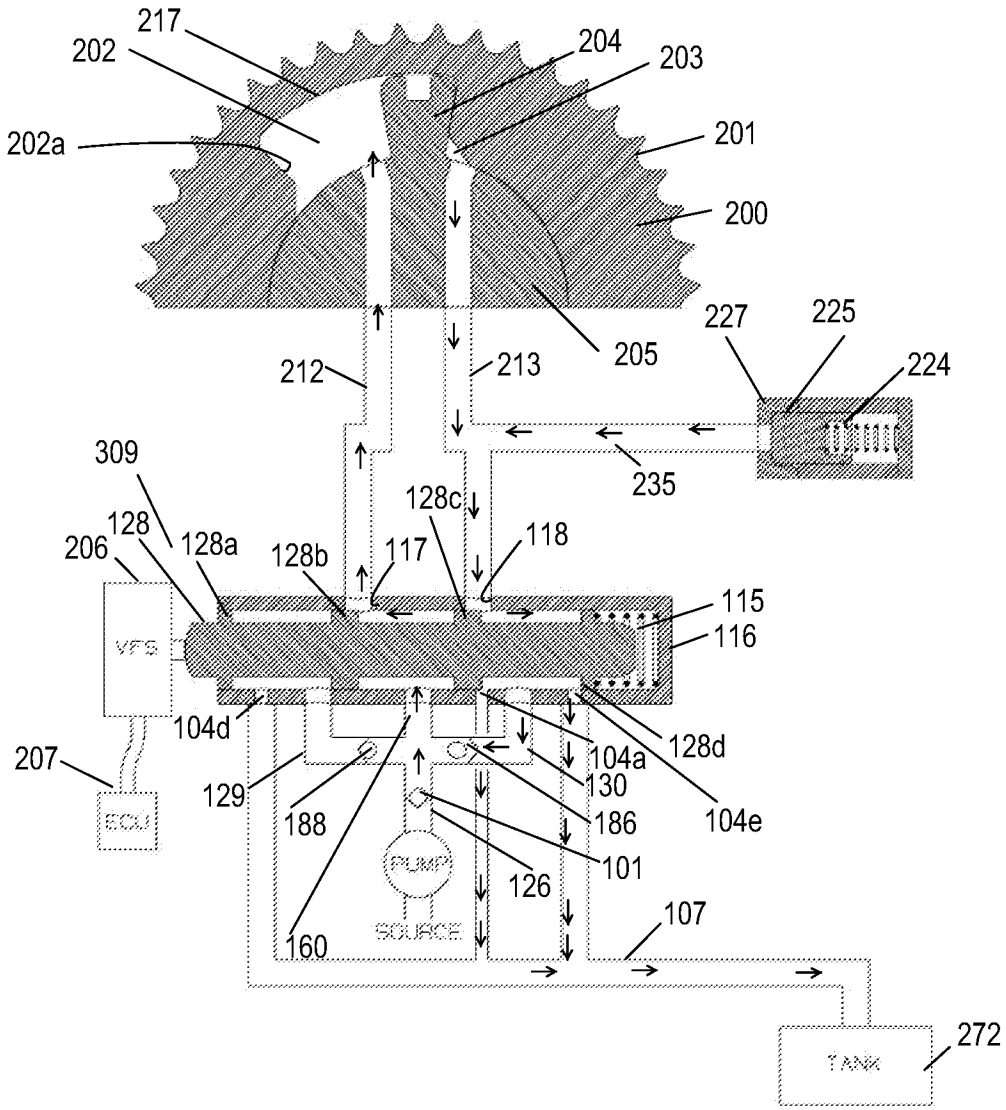
FIG. 10 shows a schematic of a variable cam timing phaser a third embodiment with additional venting.

FIG. 10 shows a phaser of a third embodiment is similar to the embodiment shown in FIGS. 4-6, but with an additional spool dependent variable vent added to the sleeve and opened when the phaser is moving toward an advance position (spool full out position). The additional spool dependent variable vent only vents at the spool out condition. The additional spool dependent variable vent allows for additional venting to increase the time and rotation the lock pin 225 to engage the recess 227 and moving to the lock position.

The duty cycle is adjusted to a range of 0-50% the force of the VFS 206 on the spool 128 is changed and the spool 128 is moved to the left in an advance mode in the figure by spring 115, until the force of the VFS 206 balances the force of the spring 115. Fluid exits from the retard chamber 203 through the retard line 213 to the second center bolt port 124 and the second sleeve port 118. From the second sleeve port 118, fluid flows between spool lands 128*c* and 128*d* to the second internal passage 130. From the second internal passage 130, fluid flows through the second recirculation check valve 186, through the third spool port 133 to the first sleeve port 117 and the first center bolt port 123 to the advance line 212. Fluid flowing through the second recirculation check valve 186 recirculates between the retard chamber 203 and the advance chamber 202 (first recirculation path 103*a*).

Fluid exiting from the retard line 213 to the second internal passage 130 additionally flows through a spool dependent variable vent 104*a* and another spool dependent variable vent 104*e* of the sleeve 116. Fluid flowing out the spool dependent variable vent 104*a* and another spool dependent variable vent 104*e* flows through passage 107 to exit the control valve 109 and flows to tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to passage 160 to the advance line 212.

Since the retard line 213 can vent to tank 272, fluid pressure in line 235 connected to the retard line 213 is not great enough to move the lock pin 225 against the force of the lock pin spring 224 and therefore, the spring force is great enough to move the lock pin 225 into engagement with a recess 227 in the housing assembly 200, locking the position of the housing assembly 200 relative to the rotor assembly 205.

In this embodiment, by having additionally spool dependent variable venting 104*a*, 104*e* when the fluid is moving towards the advance position, less fluid is recirculated from the retard chamber 203 to the advance chamber 202. With only a single spool dependent variable vent 104*b* present and open to fluid passing from the advance chamber 202 to the retard chamber 203 when the phaser is moving towards the retard position, more fluid is recirculated between the advance chamber 202 and the retard chamber 203.

Figure 12A:
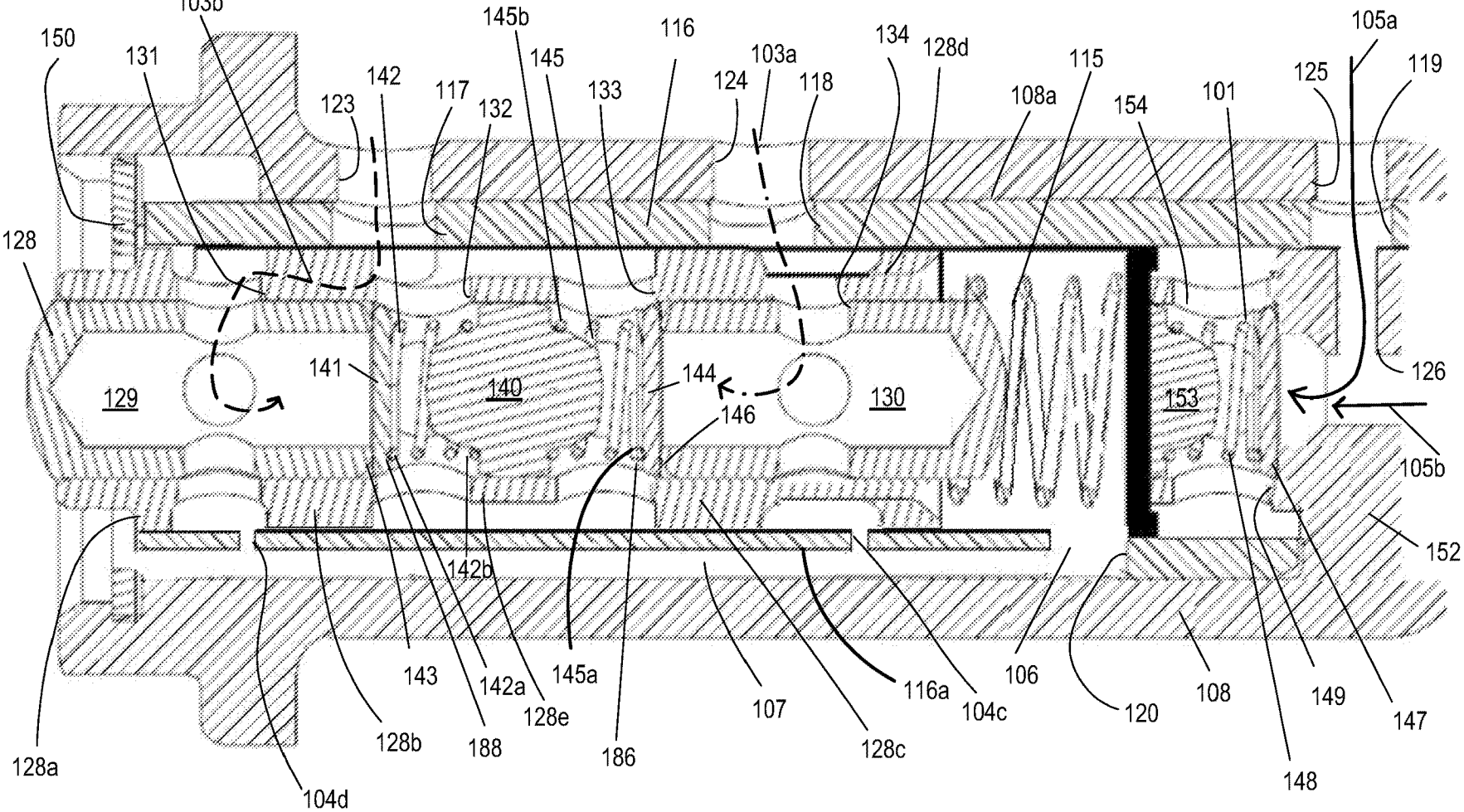
FIG. 12*a* shows a cross-section of another switchable control valve of the present invention with three check valves, two of which are recirculation check valves of a variable cam timing phaser and constant vents.
Figure 12B:
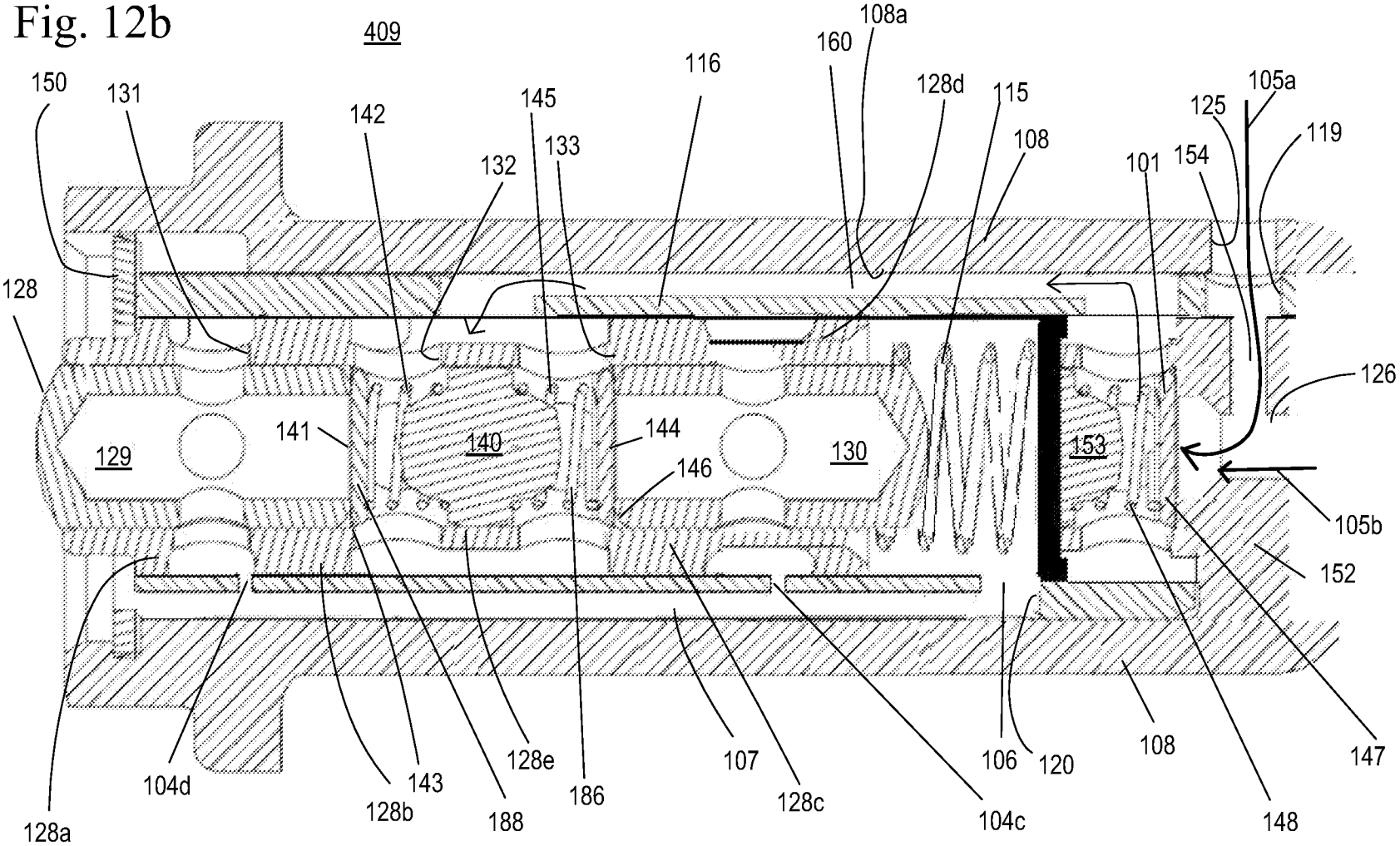
FIG. 12*b* shows another cross-section of another switchable control valve of the present invention with three check valves, two of which are recirculation check valves of a variable cam timing phaser and constant vents.
Figure 13:
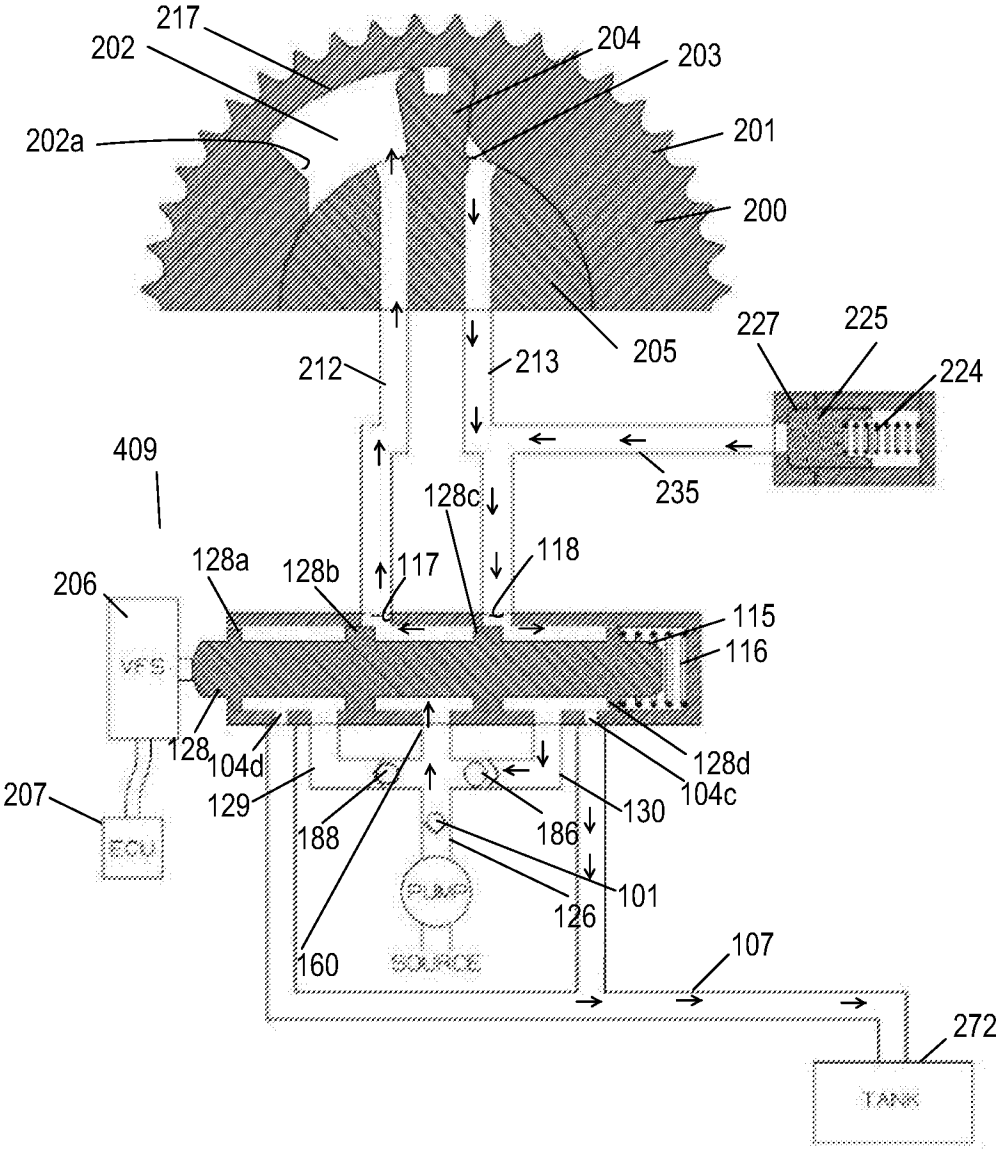
FIG. 13 shows a schematic of a fourth embodiment with a control valve including recirculation check valves and venting in an advance position.
Figure 14:
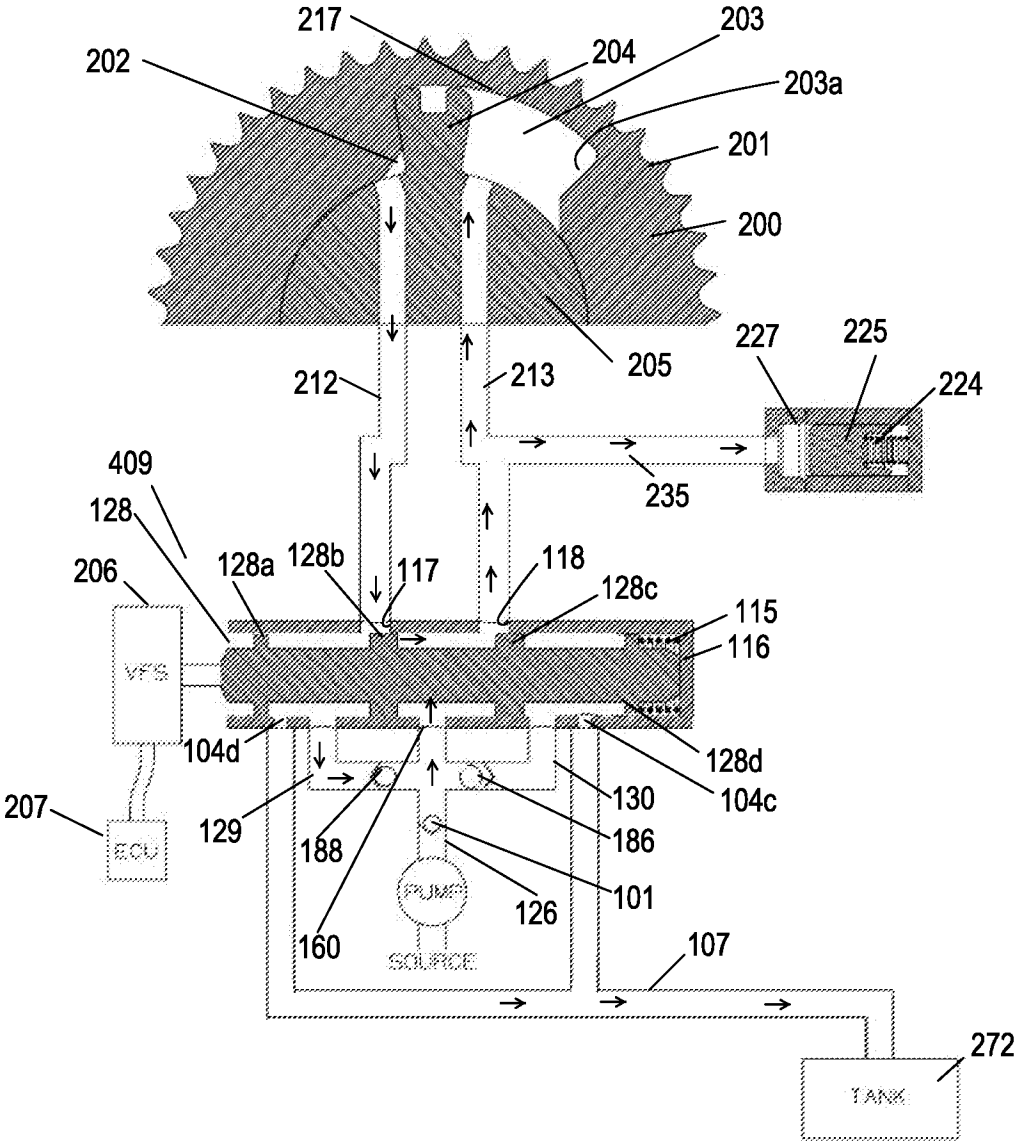
FIG. 14 shows a schematic of a variable cam timing phaser of the fourth embodiment with a control valve including recirculation check valves and venting in a retard position.
Figure 15:
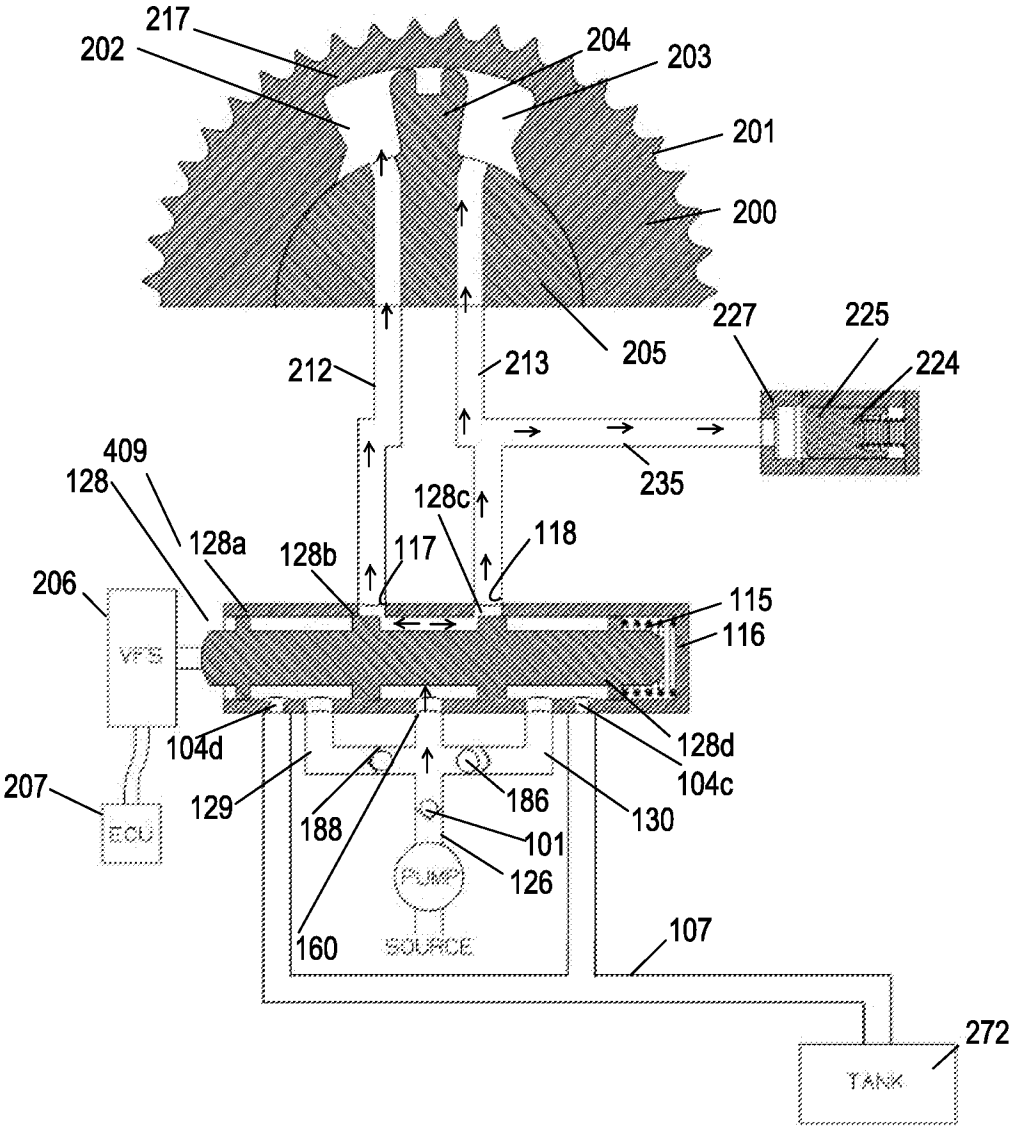
FIG. 15 shows a schematic of a variable cam timing phaser of the fourth embodiment with a control valve including recirculation check valves and venting in a holding or null position.

FIGS. 13-15 show a variable cam timing phaser of a fourth embodiment with a control valve including recirculation check valves and constant venting. FIGS. 12*a* and 12*b* show the corresponding control valve 409.

The difference between the phaser of the second embodiment shown in FIGS. 7-9 and the phaser of the fourth embodiment is the elimination of the spool dependent variable vents 104*a*, 104*b* present in the sleeve 116.

Referring to FIGS. 12*a* and 12*b*, a control valve 409 has a center bolt body 108 defining a center bolt bore 108*a*. Within the bore 108*a* of the center bolt body 108 is a protrusion 152. The center bolt body 108 has a series of center bolt ports 123, 124, 125, 126. The bore 108*a* of the center bolt body 108 receives a sleeve 116. The sleeve 116 is fixed within the bore 108*a* between a washer or retaining ring 150 and the center bolt body protrusion 152. The sleeve 116 has a plurality of sleeve ports 117, 118, 119, 120 and constant vents 104*c*, 104*d*. Within the control valve 109, at least a portion of the outer diameter 116*a* of the sleeve 116 and the bore 108*a* of the center bolt body 108 forms a passage or groove 107 and an inlet groove 160. The vents 104*c* and 104*d* are a constant size, not dependent on spool position and continuously vent fluid.

The first center bolt port 123 is aligned with the first sleeve port 117. The second center bolt port 124 is aligned with the second sleeve port 118. The third center bolt port 125 is aligned with the third sleeve port 119. The fourth sleeve port 120 and vents 104*c*, 104*d* are aligned with passage 107 between the bore of the center bolt body 108 and the outer diameter 116*a* of the sleeve 116. The fourth sleeve port 120 defines a vent 106 that is present at the back of the control valve 109.

A spool 128 is slidably received within the sleeve 116 and has a plurality of cylindrical lands 128*a*, 128*b*, 128*c*, 128*d*, 128*e*. Spool ports 131, 132, 133, 134 are present between lands 128*a*-128*e* of the spool. The spool contains a first internal passage 129, a second internal passage 130 and two recirculation check valves 188 and 186 between the first and second internal passages 129, 130.

The first recirculation check valve 188 has disk 141 which is spring 142 biased to seat on a spool seat 143. The first end 142*a* of the spring 142 is in contact with the disk 141 and the second end 142*b* of the spring 142 contacts a check valve base 140 between spool lands 128*b* and 128*c* in line with spool land 128*e*. Fluid can pass in one direction through the first recirculation check valve 188 by flowing through the first internal passage 129, biasing the disk 141 off of or away from the spool seat 143 against the force of the spring 142 such that fluid can exit out spool port 132.

The second recirculation check valve 186 has disk 144 which is spring 145 biased to seat on a spool seat 146. The first end 145*a* of the spring 145 is in contact with the disk 144 and the second end 145*b* of the spring 145 contacts a check valve base 140 between spool lands 128*b* and 128*c* in line with spool land 128*e*. Fluid can pass in one direction through the second recirculation check valve 186 by flowing through the second internal passage 130, biasing the disk 144 off of or away from the spool seat 146 against the force of the spring 145 such that fluid can exit out spool port 133.

The first and second recirculation check valves 186, 188 act independent of one another. The term "independent" meaning that the first recirculation check valve 188 is controllable or adjustable separately from the second recirculation check valve 186.

The spool 128 is biased outwards or towards the retaining ring 150 by a spring 115. An actuator 206 such as a pulse width modulated variable force solenoid (VFS), applies a force on the spool 128 to bias the spool 128 inwards or towards the center bolt body protrusion 152. The solenoid may also be linearly controlled by varying current or voltage or other methods as applicable. A first end of the spring 115*a* engages the spool 128 and a second end 115*b* of the spring 115 engages an insert 160.

The position of the control valve 409 is controlled by an engine control unit (ECU) 207 which controls the duty cycle of the variable force solenoid 206. The ECU 207 preferably includes a central processing unit (CPU) which runs various computational processes for controlling the engine, memory, and input and output ports used to exchange data with external devices and sensors.

The position of the spool 128 is influenced by spring 115 and the solenoid 206 controlled by the ECU 207. Further detail regarding control of the phaser is discussed in detail below. The position of the spool 128 controls the motion (e.g. to move towards the advance position, holding position, or the retard position) of the phaser.

Between the insert 160 and the center bolt body protrusion 152 is an inlet check valve 101. The inlet check valve 101 includes a disk 147 which is spring 148 biased to seat on a seat 149 formed on the center bolt body protrusion 152. The first end 148*a* of the spring 148 is in contact with the disk 147 and the second end 148*b* of the spring 148 contacts a check valve base 153 adjacent insert 160. Fluid can pass in one direction through the inlet check valve 101 by flowing through a center bolt port 126, biasing the disk 147 off of or away from the seat 149 against the force of the spring 148 such that fluid can exit out a check valve port 154.

While the recirculation check valves 186, 188 and the inlet check valve 101 are shown as a disk check valve, although other check valves such as ball check or band check valve may also be used.

The control valve 409 has a first recirculation path 103*a* and a second recirculation path 103*b*. The first recirculation path 103*a* is to recirculation fluid from the retard chamber 203 to the advance chamber 202. The first recirculation path 103*a* is as follows. Fluid flows from the second sleeve port 118 in fluid communication with the retard chamber 203 to the fourth spool port 134 between spool lands 128*c* and 128*d* to the second internal passage 130. From the second internal passage 130, fluid flows through the second recirculation check valve 186, exits the second recirculation check valve 186 through the third spool port 133 and flows to the advance chamber 202 through the first sleeve port 117.

The second recirculation path 103*b* is to recirculate fluid from the advance chamber 202 to the retard chamber 203. The second recirculation path 103*b* is as follows. Fluid flows from the first sleeve port 117 in fluid communication with the advance chamber 202 to the first spool port 131 between spool lands 128*a* and 128*b* to the first internal passage 129. From the first internal passage 129, fluid flows through the first recirculation check valve 188, exits the first recirculation check valve 188 through the second spool port 132 and flows to the retard chamber 203 through the second sleeve port 118.

The "distance" traveled by the fluid to recirculate between the advance and retard chambers 202, 203 is approximately equal. The recirculation path is independent from venting of fluid from the control valve 409.

In the position shown in FIGS. 12*a* and 12*b*, a spool out position, the spool 128 is positioned within the sleeve 116 as follows. The first spool port 131 between spool lands 128*a* and 128*b* and is in fluid communication with the first internal passage 129. The second spool port 132 and the output of the first recirculation check valve 188 is open to fluid communication with the first sleeve port 117 between the spool land 128*b* and 128*e* and the first center bolt port 123. The third spool port 133 and the output of the second recirculation check valve 186 is open to fluid communication with the first sleeve port 117 between spool land 128*b* and 128*c* and the first center bolt port 123. The fourth spool port 134 is between spool lands 128*c* and 128*d* and is in fluid communication with the second internal passage 130.

It should be noted that the second recirculation path 103*b* is shown for illustration purposes, but would not be present during operation of the control valve in this position.

Fluid from a source is shown as entering either through third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to groove or passage 160 between the center bolt housing 108 and the outer diameter of the sleeve 116.

FIG. 13 shows the phaser is moving towards an advance position, the duty cycle is adjusted to a range of 0-50% the force of the VFS 206 on the spool 128 is changed and the spool 128 is moved to the left in an advance mode in the figure by spring 115, until the force of the VFS 206 balances the force of the spring 115. Fluid exits from the retard chamber 203 through the retard line 213 to the second center bolt port 124 and the second sleeve port 118. From the second sleeve port 118, fluid flows between spool lands 128*c* and 128*d* to the second internal passage 130. From the second internal passage 130, fluid flows through the second recirculation check valve 186, through the third spool port 133 to the first sleeve port 117 and the first center bolt port 123 to the advance line 212. Fluid flowing through the second recirculation check valve 186 recirculates between the retard chamber 203 and the advance chamber 202 (first recirculation path 103*a*). Fluid exiting from the retard line 213 to the second internal passage 130 additionally flows through a constant vent 104*c* of the sleeve 116. Fluid flowing out the constant vent 104*c* flows to passage 107 and tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to passage 160 and to the advance line 212.

Since the retard line 213 can vent to tank 272, fluid pressure in line 235 connected to the retard line 213 is not great enough to move the lock pin 225 against the force of the lock pin spring 224 and therefore, the spring force is great enough to move the lock pin 225 into engagement with a recess 227 in the housing assembly 200, locking the position of the housing assembly 200 relative to the rotor assembly 205.

It should be noted that the amount of fluid which vents through constant vent 104*c* and the amount of fluid that recirculates to the advance chamber 202 through the second recirculation check valve 186 is based on the size of the constant vent 104*c*. If the vent 104*c* is very small or restricted, more fluid will recirculate from the retard chamber 203 to the advance chamber 202 and the phaser will function more similarly to a cam torque actuated phaser. If the vent 104*c* is large, the phaser will function more similarly to a torsion assisted phaser.

FIG. 14 shows the phaser is moving towards a retard position, the duty cycle is adjusted to a range of 50-100% the force of the VFS 206 on the spool 128 is changed and the spool 128 is moved to the right in retard mode in the figure by actuator 206 until the force of the VFS 206 balances the force of the spring 115. Fluid exits from the advance chamber 202 through the advance line 212 to the first center bolt port 123 and the first sleeve port 117. From the first sleeve port 117, fluid flows between spool lands 128*a* and 128*b* to the first internal passage 129. From the first internal passage 129, fluid flows through the first recirculation check valve 188, through the second spool port 132 to the second sleeve port 118 and the second center bolt port 124 to the retard line 213. Fluid flowing through the first recirculation check valve 188 recirculates between the advance chamber 202 and the retard chamber 203 (second recirculation path 103*b*). Fluid exiting from the advance line 212 to the first internal passage 129 additionally flows through the constant vent 104*d* of the sleeve 116. From the constant vent 104*d* fluid flows through passage 107 to exit the control valve 109 and flow to tank 272.

Additionally, fluid may be provided from a source either through the third center bolt port 125 and the third sleeve port 119 and through the inlet check valve 101 (source oil path 105*a*) or from a fourth center bolt port 126 and the inlet check valve 101 (source oil path 105*b*). From the inlet check valve 101, fluid flows through the check valve port 154 to passage 160 and the retard line 213.

Since fluid is being supplied to the retard line 213 and thus line 235, the fluid pressure in line 235 is great enough to move the lock pin 225 against the force of the lock pin spring 224 and therefore, move the lock pin 225 out of engagement with recess 227 in the housing assembly 200, allowing the rotor assembly 205 to move relative to the housing assembly 200.

It should be noted that the amount of fluid which vents through the constant vent 104*d* and the amount of fluid that recirculates to the advance chamber 202 through the second recirculation check valve 186 is based on the size of the constant vent 104*d*. If the vent 104*d* is very small or restricted, more fluid will recirculate from the retard chamber 203 to the advance chamber 202 and the phaser will function more similarly to a cam torque actuated phaser. If the vent 104*d* is large, the phaser will function more similarly to a torsion assisted phaser.

FIG. 15 shows the phaser in the holding position. In this position, the duty cycle of the variable force solenoid 207 is approximately 50% and the force of the VFS 206 on one end of the spool 128 equals the force of the spring 115 on the opposite end of the spool 128 in holding mode. The spool land 128*b* mostly blocks the flow of fluid from advance line 212 and spool land 128*c* mostly blocks the flow of fluid from the retard line 213. Makeup oil is supplied to the phaser from supply S by pump source 226 to make up for leakage and passes through the inlet check valve 101. From the inlet check valve out 154, fluid flows to passage 160, and flows to the advance line 212 and the retard line 213. Since the retard line 213 contains fluid, the lock pin 225 is in an unlocked position.

It is understood that if sufficient torque bias exists in either advance or retard direction then one or more vents can be eliminated such that the phaser operates in pure CTA mode. In other words, even though vents are shown in both the advance and retard direction it is understood that the vents sizes could be reduced to zero on either side causing the blending of TA and CTA actuation to be altered to 100% CTA in one or both directions.

In any of the above embodiments, the center bolt housing may be eliminated and the sleeve of the control valve can be fixed in a bore of the rotor assembly.

Figure 1:
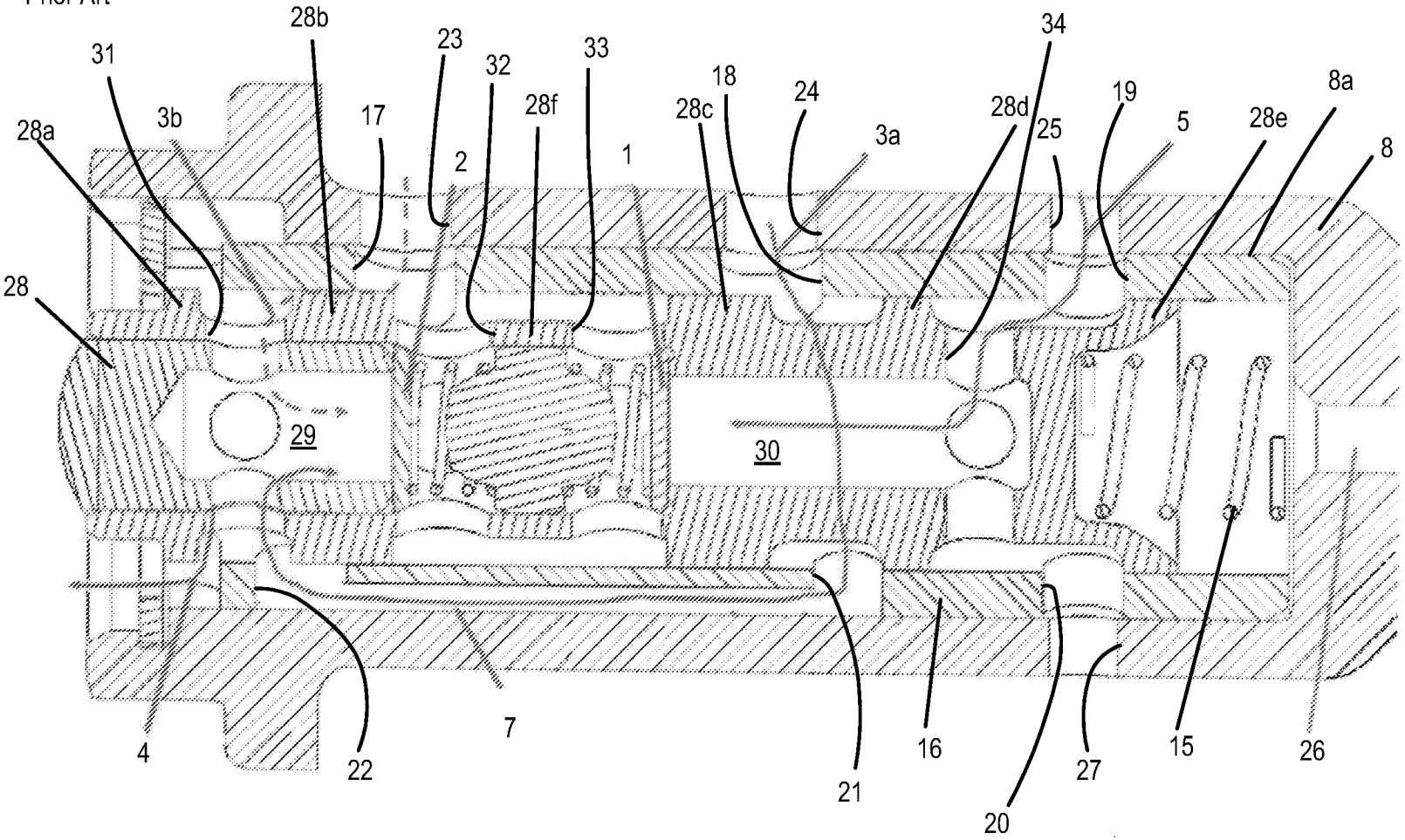
Fig. 1 Prior Art
FIG. 1 shows a schematic of a conventional switchable control valve with two check valves of a variable cam timing phaser.
Figure 2:
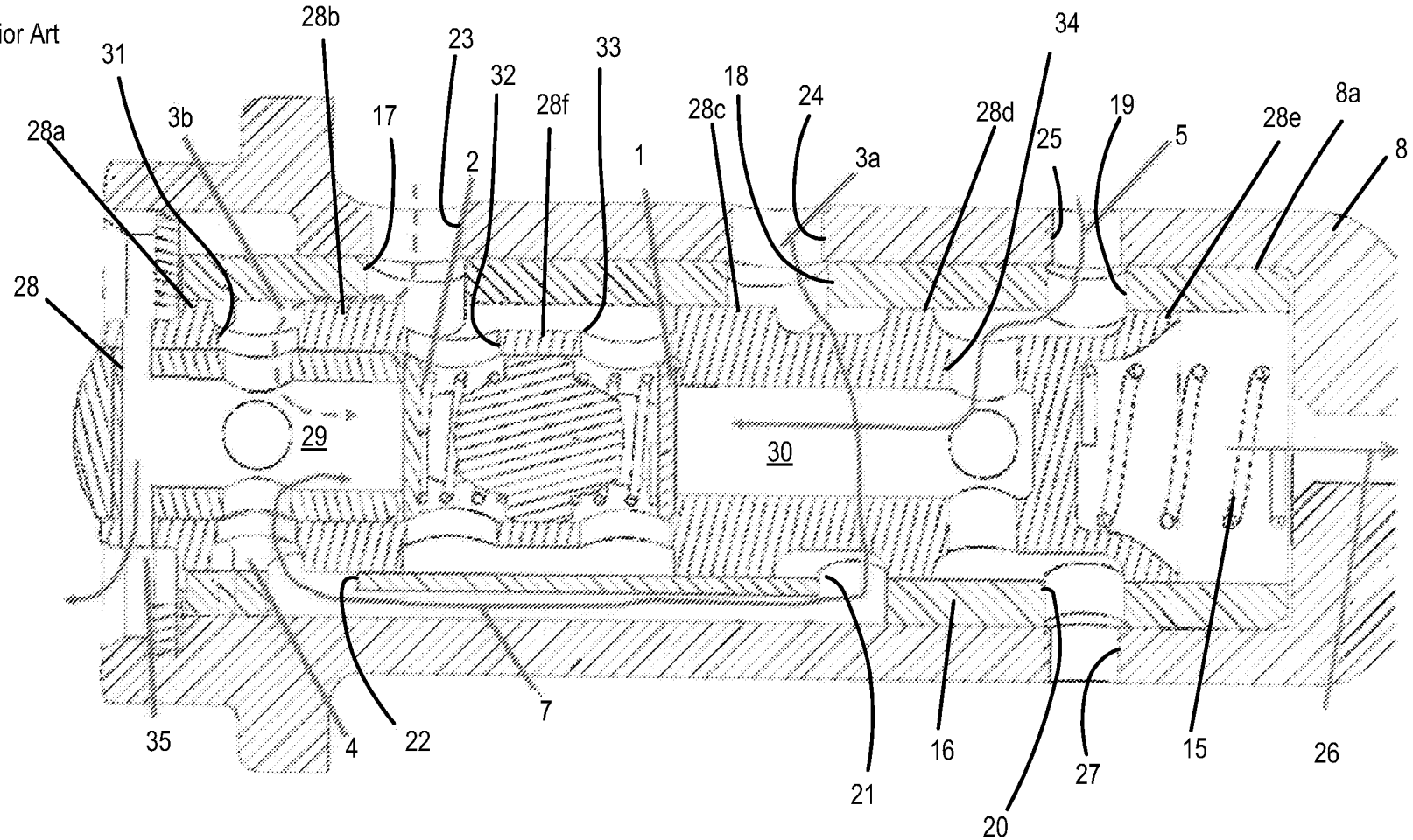
Fig. 2 Prior Art
FIG. 2 shows a schematic of a conventional switchable control valve with two check valves of a variable cam timing phaser and constant torsion assist venting.

In the above embodiments, the control valve 109 includes an inlet check valve 101, a first recirculation check valve 188, and a second recirculation check valve 186. The first and second recirculation check valves 188, 186 are independent of one another. The addition of the second recirculation check valve 186 allows for some flexibility in the hydraulic design that was not readily available in the single recirculation check design shown in prior art FIGS. 1 and 2. In an alternate embodiment, the inlet check valve 101 can be present anywhere in the inlet line and does not need to be present in the control valve.

The addition of the second recirculation check valve 186 allows a hydraulic design that addresses the concerns and limitations of the switchable technology and brings the following improvements. The recirculation flow paths 103*a*, 103*b* between the advance chamber 202 and the retard chamber 203 and the retard chamber 203 and the advance chamber 202 no longer flow through a restrictive groove 107 between the sleeve outer diameter 116*a* and the bore 108*a* of the center bolt housing 108, but rather flow internal to the control valve. Since both the recirculation flow paths 103*b*, 103*a* (advance chamber 202 to retard chamber 203 and retard chamber 203 to advance chamber 202) now have similar flow restrictions, the balance of the performance and actuation rates in both directions is improved.

There are some additional benefits that are realized in embodiment of the phaser of the present invention that has one inlet check 101 and two recirculation check valves 188, 186. For example, the vents 104*a*, 104*b* are independent to the advance and retard recirculation flow paths 103*a*, 103*b*. The TA vent size 104*a*, 104*b*, 104*c*, 104*d*, 104*e* (defined by sleeve 116 and location can be adjusted independently for a variety of reasons. Adjusting the TA venting using vents 104*a*, 104*b*, 104*c*, 104*e* relative to the camshaft torque and oil pressure energy available allows tuning of the performance of the phaser independently in the advance and retard direction. This gives the option of tuning for max performance or maximum oil efficiency (i.e. minimum oil consumption) in either direction.

The sizing of the vents 104*a*, 104*b*, 104*c*, 104*d*, 104*e* can also be used to balance the VCT actuation rate in the advanced and retard direction. The TA venting through TA vents 104*a*, 104*b*, 104*c*, 104*d*, 104*e* could be increased at spool full out (advance position) for extra torsion assist (TA) function to facilitate an improved lock pin response, if the lock pin is controlled from one of the working advance or retard chambers. The TA vents 104*a*, 104*b*, 104*c*, 104*d*, 104*e* could be closed at spool out (retard position) if desired such as when using a mid-position locking function. In general, having independent TA vents 104*a*, 104*b*, 104*c*, 104*d*, 104*e* in the advance and retard directions allows greater flexibility in managing the various VCT phaser functional and performance parameters.

The TA vents 104*a*, 104*b*, 104*e* can be dependent on the position of the spool. In other words, the vent would only be allowed or available to express or vent fluid at a specific spool position, for example spool out (advance position). The venting based on spool position can be used to tune the lock pin 225 and allow the lock pin 225 additional time and rotation in engaging the recess 227 and moving to the lock position. Additionally, the venting based on spool position would decrease the venting which takes place when the phaser is in the null position increasing the efficiency of the phaser due to less oil consumption.

Since both recirculation flow paths 103*a*, 130*b* are internal to the control valve 109, there is package space on the sleeve OD 116*a* to add a vent 106 for the back of the control valve. This vent 106 may be combined with the TA venting 104*a*, 104*b*, 104*c*, 104*d*, 190 or preferably would have its own isolated vent path down the length of the sleeve OD 116*a*. Since the flow requirements for venting the control valve 109 or managing the TA venting only are smaller than the recirculation flow path 7 utilized in the prior art control valves, the passage 107 can fit in the same space or less space occupied by the prior art recirculation flow circuit 7. By venting 106 the back of the control valve 109 down the sleeve 116, alternate source oil flow paths (105*a* and 105*b*) at the back of the center bolt housing 108 are available.

The embodiments of the present invention provide the following additional benefits over the conventional VCT technology. First, the phasers of the embodiments of the present invention use less oil than a TA phaser. By using less oil, the actuation rate tuning can be aggressive and the vents can be opened up.

Phasers are typically sized by their swept volume, or the volume of oil required to move them through a range of angular travel. The phaser of an embodiment of the present invention can operate at smaller swept volumes or pressure ratios than conventional TA phasers and based on the lower flow required they can offer a performance advantage over conventional TA phaser technology.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser comprising:

a housing assembly having an outer circumference for accepting a drive force;

a rotor assembly received by the housing assembly defining at least one chamber separated into an advance chamber and retard chamber by a vane;

a control valve comprising:

a sleeve fixed within a bore of the rotor assembly comprising: a first port in fluid communication with the advance chamber, a second port in fluid communication with the retard chamber, a third port in fluid communication with a source, a first vent in fluid communication with a sump and a second vent in fluid communication with the sump;

a spool having: a plurality of lands slidably received within the sleeve, a first internal passage, and a second internal passage;

a first recirculation check valve in fluid communication with the first internal passage and the advance chamber;

a second recirculation check valve in fluid communication with the second internal passage and the retard chamber;

a first recirculation path between the second port in fluid communication with the retard chamber, the second internal passage, through the second recirculation check valve and to the first port in fluid communication with the advance chamber, recirculating fluid between the advance chamber and the retard chamber;

a second recirculation path between the first port in fluid communication with the advance chamber, the first internal passage, through the first circulation check valve and to the second port in fluid communication with the retard chamber, recirculating fluid between the retard chamber and the advance chamber;

wherein fluid from the first recirculation path in the second internal passage is exposed to the first vent in fluid communication with the sump;

wherein fluid from the first vent and the second vent exits the control valve through a groove defined by an outer diameter of the sleeve fixed within the bore of the rotor assembly and within the bore of the rotor assembly.

2. The phaser of claim 1, further comprising a center bolt housing in the rotor assembly having a center bolt bore and a plurality of ports, the center bolt bore receiving the sleeve.

3. The phaser of claim 1, wherein the control valve further comprises an inlet check valve.

4. The phaser of claim 1, wherein the first vent is in continuous fluid communication with the second internal passage and the sump.

5. The phaser of claim 1, wherein fluid communication between the first vent and the second internal passage is dependent on a position of the spool relative to the sleeve.

6. The phaser of claim 1, wherein the second vent is in fluid communication with the first internal passage.

7. The phaser of claim 6, wherein the second vent is in continuous fluid communication with fluid from the second recirculation path in the first internal passage and with the sump.

8. The phaser of claim 6, wherein a continuous fluid communication between the second vent, the sump, and the first internal passage is dependent on a position of the spool relative to the sleeve.

9. The phaser of claim 6, further comprising a third vent in fluid communication with the sump and the second internal passage and a fourth vent in fluid communication with the sump and the first internal passage, wherein fluid communication of the first vent to the second internal passage is dependent on a position of the spool relative to the sleeve, fluid communication of the third vent is continuous with the second internal passage and the sump, fluid communication of the second vent is dependent on a position of the spool relative to the sleeve and fluid communication of the fourth vent is continuous with the first internal passage.

10. The phaser of claim 1, further comprising a lock pin slidably located in the rotor assembly, the lock pin being moveable within the rotor assembly from a locked position in which an end of the lock pin engages a recess of the housing assembly, to an unlocked position in which the end does not engage the recess of the housing assembly.

11. The phaser of claim 1, wherein the first recirculation check valve and the second recirculation check valve are selected from a group consisting of: a ball check valve, a band check valve, a disk check valve and a combination thereof.

12. The phaser of claim 1, wherein the first recirculation check valve is within the spool adjacent the first internal passage and the second recirculation valve is within the second internal passage.

13. A control valve for a variable cam timing phaser comprising:

a fixed sleeve comprising: a first port in fluid communication with at least one advance chamber of the variable cam timing phaser, a second port in fluid communication with at least one retard chamber of the variable cam timing phaser, a third port in fluid communication with a source to the variable cam timing phaser, a first vent in fluid communication with a sump, a second vent in fluid communication with the sump, a third vent in fluid communication with the sump and a fourth vent in fluid communication with the sump;

a spool having: a plurality of lands slidably received within the fixed sleeve, a first internal passage, and a second internal passage;

a first recirculation check valve in fluid communication with the first internal passage and the advance chamber;

a second recirculation check valve in fluid communication with the second internal passage and the retard chamber;

a first recirculation path between the second port in fluid communication with the retard chamber, the second internal passage, through the second recirculation check valve and to the first port in fluid communication with the advance chamber, recirculating fluid between the advance chamber and the retard chamber;

a second recirculation path between the first port in fluid communication with the advance chamber, the first internal passage, through the first circulation check valve and to the second port in fluid communication with the retard chamber, recirculating fluid between the retard chamber and the advance chamber;

wherein fluid from the first recirculation path in the second internal passage is exposed to the first vent in fluid communication with the sump; and wherein fluid from the first vent, the second vent, the third vent, and the fourth vent exits the control valve through a groove defined by an outer diameter of the fixed sleeve and a center bolt body bore of a center bolt body of a rotor assembly.

14. The control valve of claim 13, wherein the center bolt body bore of the center bolt body has a plurality of ports and receives the fixed sleeve.

15. The control valve of claim 13, further comprising an inlet check valve received within the fixed sleeve.

16. The control valve of claim 13, wherein the first vent is in continuous fluid communication with the second internal passage and the sump.

17. The control valve of claim 13, wherein fluid communication between the first vent and the second internal passage is dependent on a position of the spool relative to the fixed sleeve.

18. The control valve of claim 13, wherein the second vent is in fluid communication with the first internal passage.

19. The control valve of claim 18, wherein the second vent is in continuous fluid communication with fluid from the second recirculation path in the first internal passage and with the sump.

20. The control valve of claim 18, wherein a continuous fluid communication between the second vent, the sump, and the first internal passage is dependent on a position of the spool relative to the fixed sleeve.

21. The control valve of claim 18, wherein the third vent is also in fluid communication with the second internal passage and the fourth vent is in fluid communication with the first internal passage, and wherein fluid communication of the first vent to the second internal passage is dependent on a position of the spool relative to the fixed sleeve, fluid communication of the third vent is continuous with the second internal passage and the sump, fluid communication of the second vent is dependent on a position of the spool relative to the fixed sleeve and fluid communication of the fourth vent is continuous with the first internal passage.

22. The control valve of claim 18, wherein the first recirculation check valve and the second recirculation check valve are selected from a group consisting of: a ball check valve, a band check valve, a disk check valve and a combination thereof.

23. The control valve of claim 18, wherein the first recirculation check valve is within the spool adjacent the first internal passage and the second recirculation valve is within 4 the second internal passage.

* * * * *